United States Patent [19]

Shoji et al.

[11] Patent Number: 5,024,181

[45] Date of Patent: Jun. 18, 1991

[54] METHOD FOR THE DEVELOPMENT OF AN ELECTROSTATIC LATENT IMAGE

[75] Inventors: Hisashi Shoji; Akihiko Tamura; Masahiko Itaya; Hiroshi Fuma; Shinobu Soma, all of Hachioji, Japan

[73] Assignee: Konica Corporation, Tokyo, Japan

[21] Appl. No.: 520,117

[22] Filed: May 7, 1990

Related U.S. Application Data

[63] Continuation of Ser. No. 228,772, Aug. 4, 1988, abandoned, which is a continuation of Ser. No. 900,399, Sep. 26, 1986, abandoned.

[30] Foreign Application Priority Data

| | | | |
|---|---|---|---|
| Aug. 30, 1985 | [JP] | Japan | 60-192711 |
| Aug. 30, 1985 | [JP] | Japan | 60-192713 |
| Sep. 19, 1985 | [JP] | Japan | 60-208046 |
| Jan. 24, 1986 | [JP] | Japan | 61-14537 |
| Jan. 24, 1986 | [JP] | Japan | 61-14538 |
| Jan. 24, 1986 | [JP] | Japan | 61-14539 |
| Mar. 24, 1986 | [JP] | Japan | 61-66632 |

[51] Int. Cl.[5] ..... G03G 15/09

[52] U.S. Cl. ..... 118/658; 355/251; 355/326; 355/77; 430/122

[58] Field of Search ..... 430/122; 118/658, 645, 118/657; 355/251, 326, 77

[56] References Cited

U.S. PATENT DOCUMENTS

| | | | |
|---|---|---|---|
| 4,386,577 | 6/1983 | Hosono et al. | 118/653 X |
| 4,458,627 | 7/1984 | Hosono et al. | 118/658 X |
| 4,496,644 | 1/1985 | Ateya et al. | 355/3 DD |
| 4,498,756 | 2/1985 | Hosoya et al. | 355/3 DD |
| 4,591,261 | 5/1986 | Saruwatari et al. | 355/4 |
| 4,596,455 | 6/1986 | Kohyama et al. | 355/3 DD |
| 4,615,606 | 10/1986 | Nishikawa | 355/3 DD |
| 4,641,946 | 2/1987 | Forbes | 355/3 DD |
| 4,653,427 | 3/1987 | Hosaka et al. | 118/658 |
| 4,660,958 | 4/1987 | Egami et al. | 355/3 DD |

*Primary Examiner*—R. L. Moses

*Attorney, Agent, or Firm*—Jordan B. Bierman

[57] ABSTRACT

A method of forming a multicolor toner image on an electrostatic latent image carrying member wherein developer containing a carrier and toner is transported to a developing region on a cylindrically shaped outer sleeve member of a developer transporting unit. Inside the sleeve there is provided at least one pair of magnets, the magnetic poles of which face the inner surface of the sleeve and are so arranged as to be rotatable, relative to each other, around the center axis of the sleeve. The amount of transported toner is regulated so that the amount of toner on the sleeve [mt], in mg/cm$^2$, the peripheral speed of the image surface [$V_d$] and the peripheral speed of the sleeve member [$V_{sl}$] satisfy the following formulas:

$$|V_{sl}/V_d| \times mt \geqq 0.4 \text{ mg/cm}^2$$

$$|V_{sl}/V_3 \geqq 10$$

26 Claims, 9 Drawing Sheets

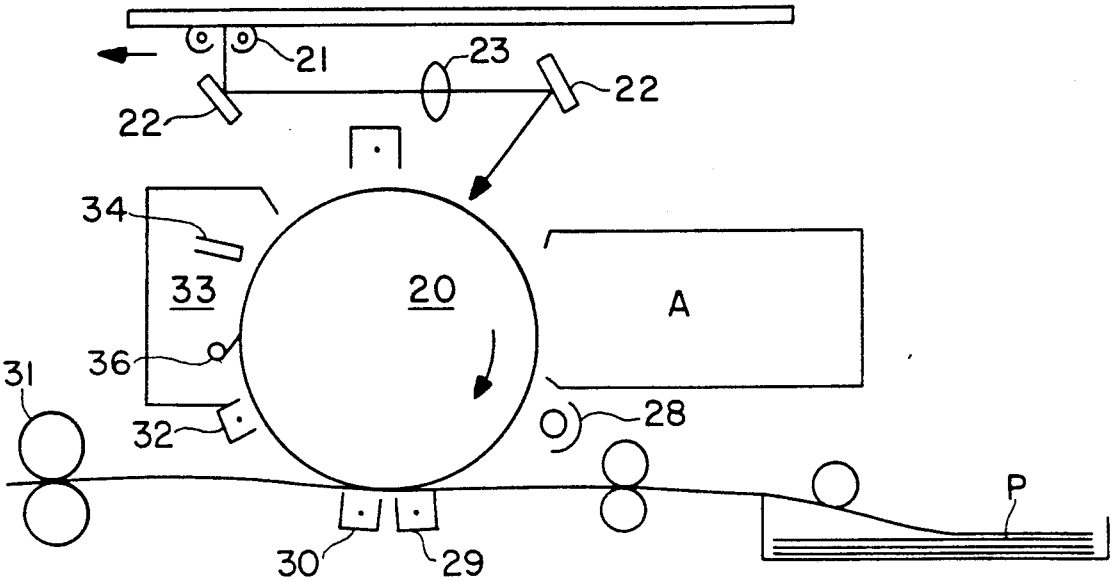
FIG. 3
FIG. 4
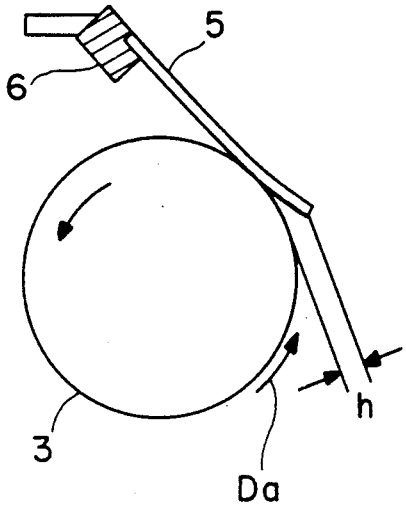

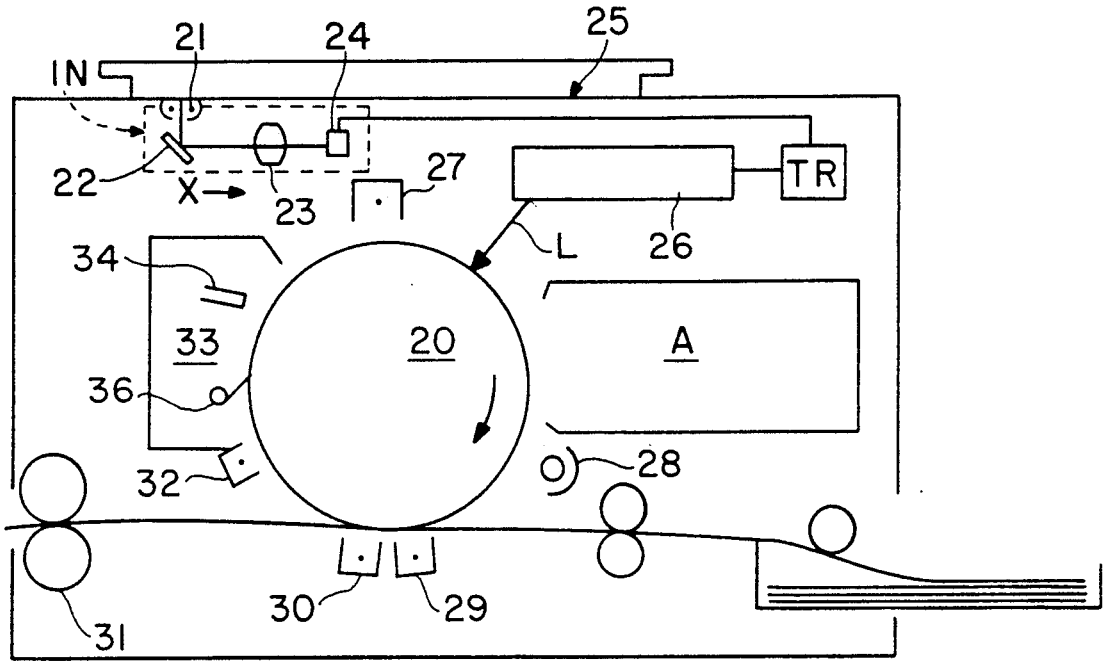
FIG. 6A
FIG. 6B
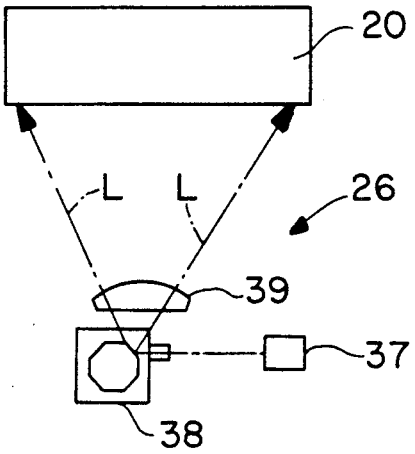

METHOD FOR THE DEVELOPMENT OF AN ELECTROSTATIC LATENT IMAGE

This application is a continuation of application Ser. No. 228,772, filed Aug. 4, 1988 now abandoned, which is a continuation of application Ser. No. 900,399, filed Sept. 26, 1986 (now abandoned).

FIELD OF THE INVENTION

The present invention relates to an image forming method, more particularly to a method to develop latent images on the latent-image carrying member to be used in electrophotography.

BACKGROUND OF THE INVENTION

There are two representative methods known in the prior art to develop latent images on the image forming material in electrophotography; one method uses a single-component developer which uses a magnetized toner that does not require a carrier, and the other method using a 2-component developer consisting of a non-magnetized or slightly magnetized toner and a magnetized carrier. The latter is considered to be advantageous in that it permits an easy control of the toner charged by friction, coloring toner freely as desired, and by its superior development characteristics. Thus, this method has been widely used. To improve the quality of the copied images, a method to develop an electrostatic latent image without directly rubbing the latent images by means of a magnetic brush formed of a 2-component developer, which is so-called non-contacting development method, has been proposed by this applicant (for example, in Japanese Patent O.P.I. Publication (Tokkai) No. 59-181362). The proposed method has another great advantage that it can be applied to a multi-color development system as disclosed in Japanese Patent O.P.I. Publication (Tokkai) No. 60-76766.

Further, the development of printers by the use of an electrophotographic process has been successfully growing. The printer of this type employs an image forming material with a sensitive layer to which an exposure by the use of laser or L.E.D. as its light source is given to form an electrostatic latent image which is subsequently developed with a toner consisting of charged particles. The image exposure is normally performed by scanning the image forming material with a light spot, however, in most coping operations a ground area or non-image portion is overwhelmingly larger than the colored area or image portion. Because of this, if exposure is performed in a manner in which light is irradiated to the ground area, the following problems may occur:

(i) The life of the light source will be shortened.

(ii) The life of the image forming material will be shortened.

(iii) The scanning unevenness of the optical system is likely to appear as lines on the ground area.

To avoid these problems to take place, a method of forming a latent image by irradiating only the area to be colored and without irradiating the ground area have been widely used. In this case, different from normal electrophotographic copying operation, since the latent image formed has a lower electric potential in the image portion than that in the non-image portion and development must be performed by means of reverse development in which toner is adhered to the low electric potential portion of the latent image.

On the other hand, as means of multi-color image forming method, a variety of methods as described below has so far been proposed: According to one method heretofore known, a multi-color image formation is carried out by piling up different colored toner images on a recording sheet by repeating usual electrophotographic image forming process including electrification, exposure, development and transfer for different color toners. Namely, an electrostatic latent image is formed in accordance with each color information such as blue, green, and red, and the formed image is subsequently developed by means of such toners as yellow, magenta, cyan, or black-colored toners. Then the developed image is transferred to such transfer materials as a recording sheet or an overhead project film so that a multi color image can be formed on the transfer material by accomplishing the above process one by one for each color toner.

This method has, however, the following disadvantages:

1. Whenever the development of one color has been completed, the developed image needs to be transferred to the transfer material resulting in the need of a larger equipment and a longer image forming time.
2. Repeated operations are liable to cause deviation from the original position.

Another multi-color image forming method has been proposed to solve the above disadvantages. In accordance with this method, plural piled up toner images are developed on an image forming material so that the transfer process can be completed at a time.

A variation of this technology that uses its desirable traits has also been proposed, wherein a multi-color image is formed by employing a means to fly toner particles to an electrostatic latent image formed on the image forming material while applying a bias containing a superimposed a.c. component to the developing device on and after the second development. In this method, no disturbance in the imposed colored toner image can occur as the developer layer does not rub the toner image formed in the previous stage.

Further explanation in regard to the performance of this multi-color image forming device is given with reference to the flow chart illustrated in FIG. 5 as follows. FIG. 9 shows the changes in the surface potential on the image forming material comprising a photo-sensitive material and a case when electrification polarity is positive has been taken to be an example; wherein PH is an exposed portion of the image forming material; DA, non-exposed portion of the image forming material; DUP, a rise in potential caused by the adhesion of the positively charged toner T1 to the exposed portion pH at the time of the first development.

1 A uniform electrification is applied to an image forming material so that it can maintain a constant surface potential E.

2 The first image exposure with such as laser, a cathode-rey tube, L.E.D. as its exposure source is given, and the potential of the exposure pH declines in proportion to its light amount.

3 The electrostatic latent image thus formed is developed by a developing device to which a positive bias nearly equal to the surface potential E of the non-exposed portion is applied. As a result, the positively charged toner $T_1$ adheres to the exposure portion pH with a relatively low potential thereby forming the first toner image. Although in the domain in which this toner image formed, the potential rises by DUP because the positive electrified toner $T_1$ adheres to the domain, this potential normally does not become equal to that of the non-exposure region DA in strength.

4 Next, the surface of the image forming material on which the first toner image was formed is electrified for the second time by means of an electrifier. As a result, a uniform surface potential E can be obtained regardless of the presence of toner $T_1$.

5 On the surface of this image forming material, the second image exposure is applied to form an electrostatic latent image.

6 The development by means of a positively charged toner T2 with a color different from that of toner T1 is performed in the same manner as in the step 3 above, and thus the second toner image can be obtained.

Thereafter, similar process is repeated several times as required and a multi-color toner image is subsequently formed on the image forming material. This image is transferred to a transfer material, and a multi-color recorded pictorial image is obtained by fixing it by heating or applying pressure. In this case, the toner and electric charge that remain on the surface of the image forming material is cleaned and the material is then used for the next multi-color image formation.

In the method described in FIG. 9, at least the developing process described in step 6 must be performed so that the developer layer will not come into contact with the surface of the image forming material.

It should be noted that in the multi-color image forming method, a step to remove the electrification of the surface of the image forming material may be carried out before the commencement of each subsequent electrification. Also, either the same or different exposure source may be used for each image exposure step.

In the electrophotography, for example, a halogen lamp, gas or semiconductor, laser light L.E.D., CRT, or liquid crystal is used as a means for exposure.

As a means to form a latent image in multi-color image formation, besides the previously described electronic photography, a method of injecting electric charge directly to the surface of the image forming material by means of multi-needle electrodes or a method to form magnetic latent image by means of a magnetic head may also be used.

In the 2-component developer used for the developing method of this kind, to improve the resolution, tone reproductivity of the toner image and over all picture quality, attempts have been made to make the particle diameter of a carrier or toner as much small as is practically possible.

For example, Japanese Patent Applications Nos. 58-238296 and 59-22018 by the present applicant disclose a technology capable of performing a non-contacting development by the use of a carrier with a smaller particle diameter of less than 30 μm instead of a conventional carrier with a larger particle diameter ranging from 50 μm to 500 μm, and a toner with a diameter of less than 15 μm.

In this technology, however, if the carrier in the developer is made to have a smaller particle diameter, binding force of the carrier with the toner tends to be weakened. This may also cause contamination inside the device by the scattering of the carrier and toner while handling the developer or during the process of image formation. Further the carrier and the toner are likely to adhere to the surface of the image, thereby causing fog and this makes it difficult to obtain a clear toner image.

To remove such occurrence of fog, the distance between the image forming material and the developer carrier may be widened, however, this weakens the development electrode effect, making the development by the toner more difficult. The developing capability is improved by applying an electric field with an oscillating component between the image forming material and a developer transporting means, however, this often causes fog in the non-image portion and the scattering of the carrier, which makes it difficult in design to electrically isolate the developing device.

Generally, in the non-contacting developing method, the magnetic brush formed on the developer transporting means including a non-magnetic sleeve (hereafter often referred to as sleeve) is separated from the surface of the latent image, namely, the brush does not contact with the image. To have the toner scatter over the latent image, a voltage with an oscillating component, namely, an A.C. bias is applied to the sleeve. However, this A.C. bias causes the carrier to adhere to the image forming material. Especially, when trying to make a uniform height of the magnetic brush as small as possible the use of a carrier with a smaller particle diameter is advantageous, nonetheless, the binding force of the carrier to the sleeve is weakened, thereby causing the carrier to scatter easily inside the device.

In the reversal development, it is often difficult to make the potential level at the ground portion of the image forming material to be uniform. This is attributed to the microscopic fluctuations in the electric charge retaining ability in the photo-conductive layer, resulting in the difficulty to attain a uniform electrification on the surface of the image forming material. This means that microscopically different forces apply to the toner and carrier and, because of this, fog in the resulting image and carrier adhesion can easily occur. Especially these phenomena are more likely to occur when an organic photoconductive material.

To remove fog, the gap between the image forming material and the sleeve be widened, however, in this case, the previously described problems will need to be dealt with.

Further, when a developer containing a carrier with small particle diameter is used in a multi-color image forming method, the binding force of the sleeve with carrier and toner is weakened. This may cause the previously described scattering of carrier and toner inside the device leading to the contamination, fog on the resulting image due to the scattering of the toner and the carrier, which makes it difficult to obtain a clear cut image.

Although such fog may be reduced by widening the distance (hereafter referred to as an image gap) between the image forming material and the sleeve, this will weaken the electrode effect as mentioned hereinafter, making the development by the toner to become more difficult. If a large A.C. electric field is created between the image forming material and the sleeve, the developing capability may be improved whereas the fog caused by the toner and scattering of the carrier on the non-image portion may be aggravated, resulting in the difficulty in the design of the electrical isolation of the developing device. Further, different color toners may get mixed with one another in the developing device, causing image colors to become unbalanced.

SUMMARY OF THE INVENTION

The object of the present invention is to provide a developing method that causes reduced contamination or adhesion of the scattering carrier or toner to the inside of the device, capable of providing a proper frictional electrification between carrier and toner to attain an excellent development despite the development by means of a developer comprising a toner and a carrier with a small particle diameter thereby producing a clear toner image with superior resolution and tone reproductivity.

Another object of the invention is to provide a developing method capable of effectively solving the above-mentioned problems inherent in the above non-contacting developing method with sufficient density and an excellent resolution, and of providing an image without noise caused by the adhesion of the scattered carrier to the device.

Still another object of the invention is to provide a developing method that is less likely to cause such problems as those mentioned above even when the development is performed by means of the reversal method which performs development by attaching the toner to the low potential portion of an electrostatic latent image by means of a developer comprising a toner and a carrier with a small particle diameter. Further, the method enables proper frictional electrification to the carrier and toner, thereby forming a distinctive image with high resolution and an excellent reproductivity. A further object of the invention is to provide a color developing method that does not cause the carrier and the toner to be scattered, resulting in reduced contamination inside the device and is free from fog on the resulting toner image and impurity in color caused by the mixing of different color toners, thereby attaining an extremely uniform development. The method thus permits the formation of a colored image with superior resolution, an excellent tone reproductivity, as well as improver color balance.

A still another object of the invention is to provide a developing device capable of being applied to the previously described different developing methods.

Other objects of the invention will be apparent from the following description.

The above-mentioned objects of the present invention can be attained by a method for the development of an electrostatic latent image on an electrostatic latent image-carrying member, wherein said method comprises, a step of supplying a developer comprising carrier and toner to a developer transporting means which includes at least a pair of magnetic poles a step of forming a thin layer of said developer on the developer transporting means so that the maximum thickness of the developer layer is smaller than the minimum distance between the surface of said developer transporting means and the surface of an electrostatic latent image carrying member provided opposite to said developer transporting member, a step of carrying said developer to a close proximity of the electrostatic latent image formed on said electrostatic image carrying member, and a step of forming a toner image on said electrostatic latent image carrying member.

BRIEF DESCRIPTION OF THE DRAWINGS

FIG. 2-*a* shows an oblique view and FIG. 2-*b*, a front view of the mixing member.

FIG. 3 is a cross sectional view of the principal sections of a copier, an embodiment of the present invention.

FIG. 4 is a cross sectional view of the principal sections of the thin layer portion.

FIG. 6 is a cross sectional view of a copier used in an another embodiment of the present invention. FIG. 6-(*b*) shows a cross sectional view of a laser exposure device to be used in the copier shown in FIG. 6-(*a*).

DETAILED DESCRIPTION OF THE INVENTION

In the present invention, the term developing domain means an area in which the toner carried by the developer transporting means can move to an electrostatic latent image-carrying member by the effect of an electrostatic force therefrom. The closest or the minimum distance between the electrostatic latent image-carrying member, i.e., an image forming material and the developer transporting means in this domain is referred to as developing gap.

Various means for practicing the invention and other advantages and novel features thereof will be apparent from the following detailed description together with drawings, however, the scope of the invention is not limited to such embodiments.

Figure 1:
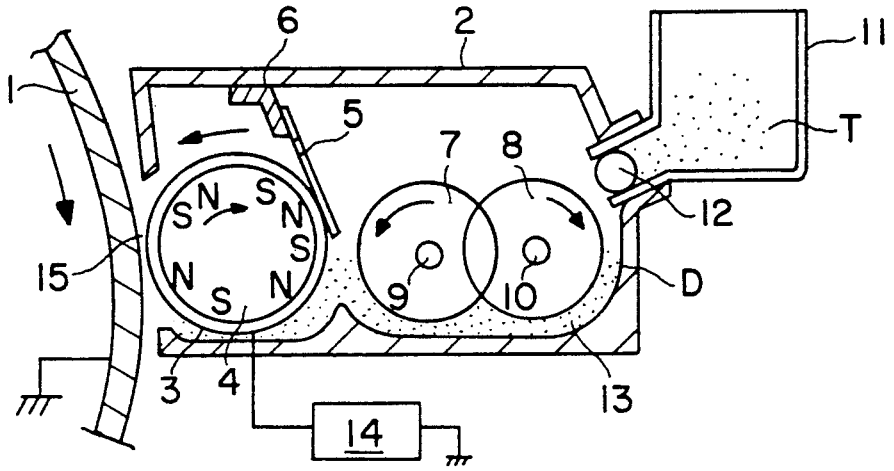
FIG. 1 is a cross sectional view of a developing device to which a developing method of the present invention can be applied.

FIG. 1 illustrates a cross sectional diagram of a preferred embodiment of a developing device in accordance with the present invention. In this diagram, numeral 1 is an electrostatic latent image-carrying member such as a photo-conductive material; numeral 2, a housing; numeral 3, a sleeve member of a developer transporting means; numeral 4, a magnetic roll with at least a pair of N and S poles, preferably more than two pairs of them provided in said sleeve member so that the magnetic poles are directed to the inner surface of said sleeve and that the magnetic roll is relatively rotatable to the sleeve member around the center axis of the sleeve member; numeral 5, a means for regulating the thickness of the developer layer; numeral 6, a member to fix the member 5; numeral 7, the first stirring number for the developer; numeral 8, the second stirring member. Numerals 9 and 10 are rotating shafts for the aforementioned stirring members 7 and 8; numeral 11, a replenishing toner container; numeral 12, a toner replenishing roller; numeral 13, a developer collector pot; numeral 14, a power supply for applying a bias to the developer and numeral 15, a development domain. Character T means a toner, and character D, a developer. In a developing device comprising such components, the developer D in the developer collector pot 13 is sufficiently stirred and mixed by means of the first stirring member 7 that rotates in the opposite direction with respect to that of the second stirring member 8 so that a part of the stirring member overwrap with each other. The developer then adheres to the surface of said sleeve member 3 and is then carried to the development domain 15 by means of the carrying force of the sleeve member 3 that rotates in the opposite direction of the arrow and of the magnetic roll 4 that rotates in the opposite direction of that of the sleeve member 3. The layer thickness regulating member 5, which is held by the fixing member that stretches from the housing 2 is pressed to contact the developer at a portion near the end of the surface to control the thickness of the developer layer D.

This developer layer is used to develop a latent image in the development domain 15 on the electrostatic latent image-carrying member 1 in a non-contact manner, i.e., so that a magnetic brush of the developer does not contact with the latent image to form a toner image on the latent image carrying member 1 that rotates in the direction of the arrow. During development, a developing bias including A.C. component is applied from the power supply 14 to said sleeve 3. As a result, only the toner in the developer on the surface of the sleeve 3 is selectively moved and adheres to the surface of the latent image.

On the other hand, in the reversal development method, a developing bias comprising A.C. and D.C. components, each of which has about the same degree of potential as that of non-exposure portion of the latent image carrying member 1 is applied from the power supply 14 to said sleeve member 3. As a result, only the toner in the developer in the surface of the sleeve member 3 is selectively moved and adheres to the said latent image. This D.C. component is indispensable to perform a reversal development.

One of the distinctive features of this invention is that it is capable of creating an extremely thin developer layer with a thickness of less than 500 μm preferably less than 400 μm, which has not been attained by the conventional device in the development domain 15. Because of this, although the latent image-carrying member 1 does not make contact with the magnetic brush formed by the image forming material 1, development becomes possible. The term developer layer thickness as used in the present invention means the maximum height of the magnetic brush formed on the sleeve member 3 by the effect of the magnetic pole 4.

According to developing method in accordance with the present invention, even when the binding force between the carrier and toner of the developer or that between the carrier and sleeve member is weak, since the development layer is made to be extremely thin, the carrier and toner can sufficiently adhere to the sleeve member without causing scattering.

Further, by carrying out development in a non-contacting manner, occurrence of fog or adhesion of the carrier in the reversal development is effectively prevented.

In this case, even if the toner in a thin developer layer on the sleeve is lost due to development, if sufficient toner is supplied into this thin layer promptly, the developing ability will not be affected. For this reason, it is desirable that a magnet in the sleeve member is made rotated at high speed.

To attain the most efficient development by means of a thin layered developer carried into the development domain, the following conditions are preferably satisfied:

(1) The magnetic roll installed near the sleeve member is rotated at high speed.
(2) An A.C. bias is applied to the sleeve member 3.
(3) The gap between the latent image carrying member 1 and sleeve member 3 is made smaller as much as is practically possible.

In the non-contacting developing method, namely, the developing method in which the maximum length of the magnetic brushes in the development domain is made smaller than the developing gap, if the developer layer is made thinner, the gap between the latent image-carrying member 1 and sleeve member 3 can also be made smaller.

As a result, toner particles can easily be flown in the oscillating electrical field caused by the application of a low potential developing bias. Accordingly toner scattering can be reduced in this respect. At the same time leak discharge from the surface of the sleeve member may also be prevented. Further, when this gap is made small, intensity of the electrical field formed by the latent image is strengthened.

As a result, delicate changes in tone and file patterns can well be developed.

According to a preferred embodiment of the present invention, the adhesion of the carrier to the inside of the device can be prevented effectively by applying a bias with an oscillating component between the above developer carrier and the latent image-carrying member and, simultaneously, by making the voltage peak-to-peak Vp-p of the bias, the maximum height of the developer layer, or magnetic brush h and the gap d between said latent image-carrying member and the sleeve member satisfy the following relation in the development domain.

$$5 \leqq \frac{VP-p}{d-h} \leqq 50 \text{ KV/mm}$$

In the sense used here, the maximum height of the magnetic brush means the highest turf of the developer among those formed on the sleeve member.

Figure 12:
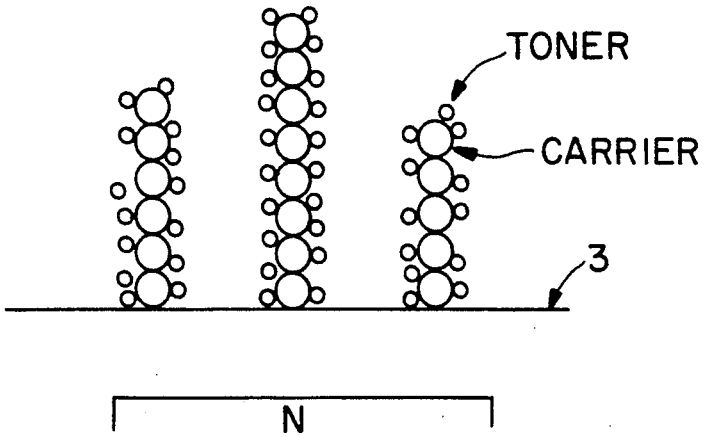
FIG. 12 is an enlarged cross sectional view of the portion near the surface of the sleeve.

The inventor of the present invention made microscopic observations on the surface of the sleeve member 3 by forming a developer layer on this sleeve under appropriate condition by using the developing device shown in FIG. 1. The observations revealed that a large number of magnetic turfs of which average length was 300 μm were standing without touching with one another right above the magnetic roll. FIG. 12 is a schematic model of an enlarged cross sectional view near the surface of the sleeve showing such status. Among these magnetic brushes, the largest length of the turf was found to be 450 μm.

The gap d between the latent image-carrying member and the sleeve member, namely, the development gap was set to 500 μm, and the latent image-carrying member, sleeve and magnetic roll were rotated at an appropriate speed, and a bias was applied to the sleeve. When this voltage was set to 3 KVp-p, carrier adhesion to the latent image-carrying member was observed. When the voltage was lowered to 2.5 KVp-p or less, the carrier adhesion substantially decreased and no adhesion was seen at 1.5 KVp-p or less. It should be noted that the toner in the developer used for this experiment was of negative electrification type and the potential of the latent image-carrying member was zero. Besides the vibrating bias, when a D.C. bias of +300V or less was applied to the sleeve, the same result was obtained.

Next, similar tests were performed with the development gaps set at 500 μm and 600 μm. As a result, it had become clear that when the development gap is set at 550 μm, if voltage becomes 5 KVp-p or more, the adhesion of the carrier tended to increase substantially, but below this voltage, virtually no carrier adhesion was observed, and at less than 3 KVp-p, no carrier adhesion was seen at all. Also when the development gap was 600 μm, almost no carrier adhesion occurred at less than 7.5 KVp-p, and no adhesion was seen at all at less than 4.5 KVp-p.

The term development gap as used here means the shortest gap or the minimum distance between the surface of the latent image-carrying member and the surface of the sleeve member.

From the above experimentation, the inventor of the present invention have found that the strength of the oscillating electric field that occurs in the space between the magnetic brush and latent image-carrying member is related to the carrier adhesion. Namely, it was found that when the strength of the above electric field is less than 50 KV/mm (between peaks), the carrier adhesion to the latent image-carrying member decreases abruptly, and further, at less than 30 KV/mm, no carrier adhesion takes place at all. Also, when voltage is less than 5 KV/mm, the image density becomes insufficient.

The result of this experimentation can be applied to the actual development. That is, the phenomenon that carrier adheres to the background portion of an image can be prevented effectively if the development is performed under the above condition.

If the development layer on the sleeve is made thinner, the amount of toner carried into the development domain will generally become smaller thereby making the amount of development smaller. To make the amount to be carried greater, rotating the sleeve at high speed is effective. However, line speed ratio between the surface of the latent image-carrying member and the surface of the sleeve member becomes greater than 1:10, a parallel speed component of the toner to be developed with respect to the surface of the latent image becomes greater, thereby causing the directionality to appear in the development and deteriorating picture quality.

On the other hand, to permit toner image to have a sufficient density, the toner should adhere to the image portion of the latent image-carrying member with a density of more than 0.4 mg/cm$^2$. To accomplish this object, when the line speed ratio between the latent image-carrying member and the sleeve member is 1 to 10, the toner is adhered to the surface of the sleeve, preferably, with a density of more than 0.04 mg/cm$^2$.

By all accounts described above given that line speed near the sleeve member is Vs1, the line speed Vd whose + is the same direction as that of the sleeve member in the development domain on the surface of the latent image-carrying member, the amount of toner per unit area in the thin layer on the surface of the sleeve member immediately before the development domain, mt, the developing method preferably meet the following equation:

$$\left|\frac{Vsl}{Vd}\right| \cdot mt \geqq 0.4\ [\mathrm{mg/cm^2}]$$

$$|Vsl/Vd| \leqq 10$$

The mt is a density on a predetermined area on the sleeve member and this area means the area enclosed between the neighboring magnetic poles of the same polarity. This toner density can be obtained by measuring the weight of the developer on the sleeve by sticking it to an adhesive tape, by measuring the weight of the toner from the toner density, and by converting this value into a unit area.

In consideration of development efficiency based on the results of many experimentations, the developing method should preferably meet the following relations:

$$\left|\frac{Vsl}{Vd}\right| \cdot mt \geqq 0.5\ [\mathrm{mg/cm^2}]$$

$$\left|\frac{Vsl}{Vd}\right| \leqq 8$$

Further experimentations in which other conditions are slightly varied and the experimentations related to the reversal development method have revealed that it is best that the developing method meet the following relations:

$$\left|\frac{Vsl}{Vd}\right| \cdot mt \geqq 0.5\ [\mathrm{mg/cm^2}]$$

$$\left|\frac{Vsl}{Vd}\right| \leqq 5$$

The ratio of the toner to carrier in the developer at this time is preferably in such a way that the ratio of the total area of the toner to carrier per unit volume is 0.5 to 2.

If developing conditions are set in the manner as described above, the toner in the thin developer layer on the sleeve member can contribute efficiently to the development with stable developing characteristics, thereby producing an excellent picture quality. As is clear from the results of experimentations mentioned above, the surfaces of the latent image-carrying member and the sleeve member facing to each other may rotate in the opposite direction to each other, but it is preferable that they be rotated in the same direction.

As a means to form a thin developing layer described above, such common conventional layer thickness regulating member as a control plate, preferably a magnetic control plate arranged with a fixed gap between it and the surface of the sleeve, and a magnetic roll that controls the developer layer thickness by means of a rotating magnetic field arranged near the sleeve are used. Among the means of this kind, to eliminate dust, fiber, and paper dust present in the developer or to eliminate impurities such as coagulated substance in the carrier, a method that provides a layer forming member consisting of a pressure contacting plate that is elastically and lightly pressed to contact with the sleeve are used in preference to other methods.

This layer thickness regulating member or layer control member is provided in parallel with the surface of the sleeve. It is an elastic plate being pressed so that its front end faces the upper stream of the sleeve rotation, and is designed to form a thin layer by passing the developer between the sleeve and elastic plate.

FIG. 4 shows the principal portions of the thin developer layer forming section. The developer is carried in the arrow Da direction by means of the rotation of the sleeve member 3 and other method. When reaching the end of the layer control member 5, the developer is divided into two; one passes through the gap between the layer control member 5 and the surface of the sleeve 3, and the other is carried to the upper part of the layer controlling member 5 without passing through the aforementioned gap, and only the former can reach the development region. Therefore, the size of said gap (namely, the distance between the tip of the layer controlling member 5 and the sleeve, and hereafter it is referred to as h) is closely related to the amount of the developer to be carried.

Figure 5:
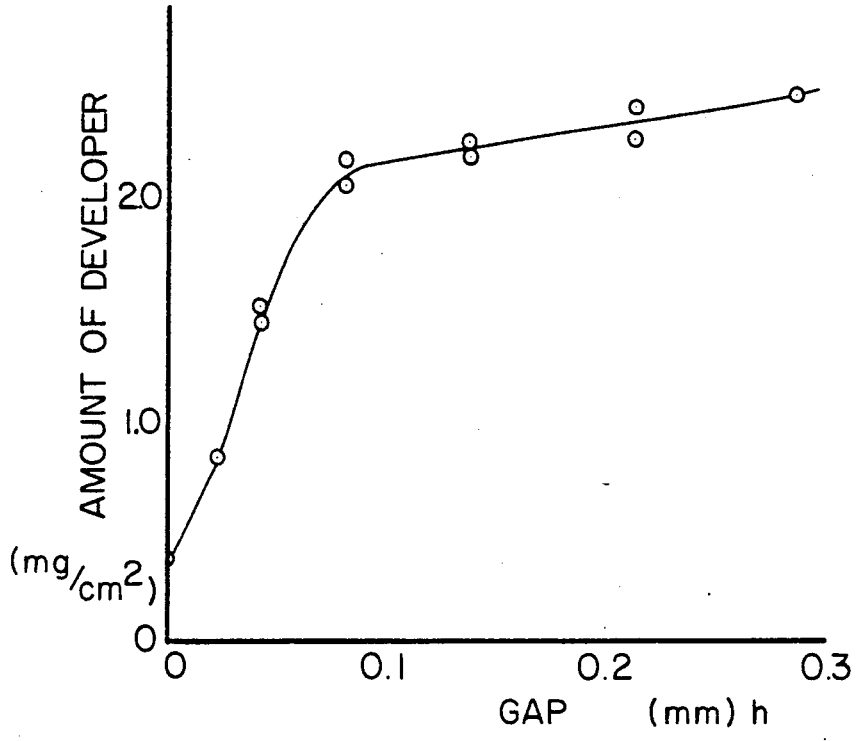
FIG. 5 is a graph that shows relations between the gap between layer thickness-regulating, member and a sleeve member, and the amount of the developer adhered to the surface of the sleeve.

FIG. 5 shows the results of experimentations by taking the aforementioned gap h as the horizontal axis and the density of the amount of the developer adhered to the surface of the sleeve as the vertical axis. It is clear from this diagram that when the gap attains more than a fixed value, the amount of the developer on the sleeve can be stabilized with respect to the changes in the size of the gap and the amount of the developer carried. In such a stable status, the amount of the toner required for development can be carried as desired. Other experimentations have also revealed that there is almost no change in the thickness of the thin layer as time elapses, and the room temperature and other parameters have almost no effect on the occurrence of stable situation.

Therefore, if the gap at the tip of the layer controlling member 5 is made to more than 0.08 mm, a stable and fixed amount of the toner can be carried regardless of the precision in installation and fluctuations in mechanical accuracy. Further experimentation revealed that if the gap at this tip is made to more than 0.1 mm, the stability to send a fixed amount of the toner can be improved. As a matter of course, it is undesirable that the aforementioned gap at the tip of the layer controlling member is made too large because observations are made that if the gap is made to more than 5 mm, it can collapse the evenness of the layer. Note that the developer layer thickness may be measured in the following manner; the layer thickness can be obtained by comparing the position of the projected image of the sleeve screen with that of the projected image in a state in which a thin layer is formed on the sleeve by using a Nikon projector manufactured by Nippon Kougaku Co., Ltd.

The aforementioned layer forming member 5 is made of extremely thin and evenly formed thin plate with a thickness of 50 μm to 500 μm consisting of such material or a non-magnetic metal, metallic compounds, plastic, and rubber, whose one end is fixed by the fixing member 6 and is given elasticity.

As described above, the sleeve member 3 is elastically pressed to a portion near the other end of the layer forming member 5 whose one end is fixed, and both the sleeve 3 and magnetic roll 4 are rotated. The developer is divided into two flows by the gap formed between the tip of the layer forming member 5 and the surface of the sleeve 3. Of the two developer flows, one enters between the layer forming member 5 and the sleeve 5 and advances slowly while receiving high pressure from its surrounding surface. When the developer's advancing strength overcomes the layer forming member's pressing strength, it can pass through the position where the layer forming member 5 comes into contact with the sleeve 3. Thus, the amount of the developer to be carried to the development domain can be determined. Although it is most preferable that the position at which the layer forming material 5 and sleeve 3 is conditioned so that the carrier particles car pass through one by one, but applicable embodiments are not limited to this.

Thereafter, the developer on sleeve 3 forms a magnetic brush with an extremely short length which do not touch with one another. If the magnetic brush is observed in a microscopic scale, it is observed as a thin layer. The particles of the impurities in the developer and such things as coagulated substances in the toner are larger than the particles of the carrier and they are less likely to pass through the said control position. Consequently an extremely thin, uniform, and stable development layer arriving at development domain 15 can always be obtained.

Note that the amount of developer carried and arrived in development domain 15 can be controlled by changing the press-to-contact force of contact-to-press angle of layer forming member 5 with respect to sleeve 3. The thickness of the layer becomes, however, almost constant between the range of 10 μm and 500 μm. It is commonly recognized that the smaller the particle diameters of the toner and carrier in a developer, the better from the viewpoint of resolution of picture quality and tone reproductivity can be obtained. For example, when the particle diameter of the toner is made 5 μm and when the particle diameter of a carrier is less than 50 μm, even when it is made to be less than 40 μm, a uniform thin developer layer can be formed while automatically removing impurities, and particles and coagulated substances in the developer by using such means as a layer forming member 5 of the present invention. Even when the aforementioned carrier is made to have a particle diameter as small as the toner's diameter, impurities are similarly prevented from mixing with the developer so that a uniform thin layer can be formed.

To prevent carrier from adhering to latent image-carrying member, i.e., an image forming member, it is preferable that the carrier particle diameter be made as large as possible because the larger is the carrier particle diameter, the stronger magnetic strength the carrier particles can receive. For example, even when the carrier particle diameter is in the range of 50 μm to 100 μm, a thin uniform development layer can be formed by means of the above-mentioned method. Incidentally when the carrier particle diameter becomes larger it may cause the height of turfs in the thin layer to become longer, making the layer to become coarse and resulting in a poor development quality. From this viewpoint, it is desirable that the carrier particle diameter be made to be less than 100 μm when the magnetization is in the range of 20 emu/g to 30 emu/g.

An oblique view and a front view of stirring members 7 and 8 showing their concrete structures that are to be incorporated in the above-mentioned development device are shown in FIG. (2)-*a* and FIG. (2)-*b*. In the same diagram, alphabet-numerals *7a*, *7b*, and *7c* mean the stirring blades of 1st stirring member, and alphabet-numerals 8*a*, 8*b*, and 8*c*, the stirring blades of 2nd stirring member and a variety of stirring blade variations are available including square plate and disk blades, and oval-shaped disk blades. They are fixed in a different angle or at a different position with each other with respect to revolving shafts 9 and 10. Because the said two stirring members 7 and 8 are structured so that their stirring areas overwraps with each other but without colliding with each other and because the stirring plates are tilted (FIG. 2), stirring in left and right direction in the developing device as shown in FIG. 1 is sufficiently performed as well as front and behind direction.

The toner T which is replenished from hopper 11 via replenishing roller 12 can also be mixed evenly in the developer D in a short period.

The use of such a stirring means is desirable because even when the previously described toner and carrier with a small particle diameter is used, a sufficient uniform developer mixing is possible. The application of the present invention is not, however, limited to this embodiment.

The developer D which is sufficiently stirred and given a desirable frictional electrification is controlled so that it can make an extremely thin and uniform layer by means of the layer forming member 5 during a process in which it adheres to the surface of sleeve 3 and is then carried. This developer layer is carried in one direction by means of the rotation of sleeve 3 and it simultaneously receives a magnetic bias comprising an oscillating component caused by the rotation of magnetic roll 4 in the opposite direction of that of the sleeve 3. Thus the developer performs complicated movements such as rolling on the said sleeves and thus when it arrives in development domain 15 and develops the latent image of image forming material 1 without making contact with this member, the toner can be effectively supplied to the surface of the latent image-carrying member. As previously described, since the said developer layer can be made into an extremely thin layer with a thickness ranging from 500 μm to 100 μm, this will permit a sufficient non-contacting development even when the gap between image forming material 1 and sleeve member 3 is narrowed, for example, to the extent of 50 μm. If the developing gap is narrowed as described above, it will cause the electric field of development domain 15 to become larger, thereby permitting a sufficient development even if a small developing bias is applied to sleeve 3, simultaneously with an advantage of a reduced leak discharge of the developing bias. Further, because the contrast of latent image is enlarged, the resolution of a toner image obtainable through development and the entire picture quality can be improved.

The developing method in accordance by the use of an extremely thin developer layer has a remarkable effect when it is employed in a developing device employing a cylindrical sleeve having a small diameter. In the past, when attempting to perform a non-contacting development by means of a sleeve having a diameter as small as less than 30 mm, conventional devices usually need a developing gap of about 1 mm because of difficulty in controlling the thickness of the developer layer. Because of this, a high pressure A.C. bias was required, which often resulted in a deterioration in the resolution of a toner image obtained through development in tone reproductivity and in over all picture quality. Especially, there have been such disadvantages as the impossibility to sufficiently reproduce fine letters or difficulty in design because of problems related to the electrical isolation of the developing device.

In consideration of such disadvantages, according to the developing method of the present invention, development is performed by forming an extremely thin and uniform developer layer, which results in a sufficiently large electric field and contributes to the improvement of the resolution of a toner image and picture quality.

Further, another effect produced by use of the developing method of the invention is that even when toner and carrier with small particle diameter are used, scattering of them can effectively be restrained. Namely, when development is carried out by the use of a conventional developer consisting of a toner and a carrier with a small particle diameter, the toner and carrier tend to scatter easily and thereby, contaminates the device and fog occurs easily. On the other hand, the developing method in accordance with the present invention can produce an extremely thin developer layer which can be sufficiently attached to the surface of sleeve 3 by means of the magnetic force of magnetic roll 5 thereby restraining the aforementioned scattering of toner and carrier to a minimum.

Another effect of the present invention is to prevent carrier from sticking to the surface of latent image-carrying member because the development is performed by means of a non-contacting development method, and only toner is selectively flown onto the surface of the latent image for development. Also, since the surface of latent image is not rubbed, neither damage to nor sweep grain on the surface of the image forming material occur, and an image with excellent resolution and tone reproduction ability can be obtained with sufficient toner density. Further, development can be performed repeatedly on top of a toner image formed or the image forming material and thus the present invention is suitable for multi-color development.

It should also be noted that the following variations and modifications can be effected to obtain a multicolored image within the spirit and scope of the invention:

(i) Means for developing one latent image by means of one kind of toner to obtain a multicolored image by changing the toner at each development.

(ii) Means for developing one latent image in succession by using plural toners. As a result, a toner image with more than two different colors piled up can be obtained.

(iii) Means for developing more than two latent images with the same kind (one kind or plural kinds) of toner. As a result, a pictorial image can be synthesized.

In the method of the present invention in order to secure a stable development it in preferable for the developer layer to have a thickness of 10 μm to 500 μm, preferably less than 400 μm, and a developmental gap of 200 μm to 700 μm and the relations among the revolving speeds of sleeve 3 and image forming material 1, and the amount of toner attached to the surface of the sleeve meet the relation mentioned hereinbefore.

Next, the compositions of the toner that can be used in the development in accordance with the invention are as follows:

1 Thermoplastic resin (binder): 80 wt %–90 wt %
  Examples: Polystyrene, styrene-acrylic acid ester copolymer, polyester, polyvinyl butyral, epoxy resin, polyamide resin, polyethylene, ethylene-vinyl acetate copolymer, or a mixture thereof.
2 Pigment (coloring agent): 0 wt % to 15 wt %
  Examples: Carbon black
    Yellow: Bengidine derivatives
    Magneta: Rhodamine B, carmine 6B, etc.
    Cyanine: Phthalocyanine and sulfonamide derivative dyestuffs
3 Electric charge controlling agents: 0 wt % to 5 wt %
  Plus-charge toner: an nigrosine electron providing dyestuffs, an alkoxylated amine, an alkyl amide, chelating agents, pigments, guardrivalent ammonium, salts
  Minus-charge toner: Electron receptive organic complexes, chlorinated paraffines, chlorinated polyesters, polyester with an excess acid radical, and chlorinated copper phthalocyanine
4 Fluidizing agent
  Examples: Colloidal silica, hydrophobic silica, silicon varnishes, metallic soap, and nonionic surface active, agents, etc.
5 Cleaning agent (used to prevent the formation of toner filming on the photo-conductive materials)
  Examples: Metal salts of fatty acids, oxidized silicon acid with an organic group on its surface, fluorinated surface active agents, etc.
6 Fillers (used to improve the surface luster of a toner image and to reduce the costs of materials)
  Examples: Such materials as calcium carbonite, clay, talc, pigments, etc.
    Besides these materials, to prevent fog and the scattering of toner over the surface of the image, a small amount of magnetic powers may be mixed with such materials. Such magnetic powders to be used include triiton tetroxide with a particle diameter of 0.1 mm to 1 mm. γ-ferric monoxide. chlorine dioxide, nickel ferrite iron alloy powers, etc. may be mentioned. These magnetic materials are incorporated in the toner in a quantity of 0.1 wt % to 5 wt %. Also, to obtain a distinctive color tone, especially to obtain a clear-cut colored toner image, it is preferable that the content of said magnetic powers be made to be less than 1 wt %.

As the resins suitable for use with a toner to be fixed by pressure to paper by means of plastic deformation with a force of about 20 kg/cm, such viscous resins as waxes, polyolefines, ethyelene vinyl acetate copolymers, polyurethanes and rubbers may be used.

By use of the above-mentioned materials, toner can be prepared by means of a known production method. When the toner is used according to the present invention, it is preferable that the toner has a diameter (weight average) be of less 15 μm, and more preferably, in the range of 9 μm to 1 μm.

When the particle diameter exceeds 9 μm, to obtain a toner image with an excellent resolution and tone reproductivity becomes rather difficult and when the particle diameter is more than 15 μm, the resolution of a fine letter will be degraded. Also, when the particle diameter is less than 1 μm, fog and the scattering of toner are likely to occur, which makes it difficult to obtain a distinctive pictorial image.

Note that the particle diameters of toner and carrier or the average particle diameter used in the invention means an weight average particle diameter, and the said average weight particle diameter is measured by means of a Colter counter. (manufactured by Colter company.) Also, the specific resistance of a particle can be determined by putting the particles into a container with a cross sectional area of 0.50 $cm^2$, by applying a load of 1 kg/cm on the packed particles to make the thickness of the layer of the particles to be about 1 mm and by generating an electric field of $10^2$ V/cm to $10^5$ V/cm between the load and the bottom electrode.

Also, the compositions of a carrier are as described below. Basically, those that are previously described as the materials used to create a toner are used.

A carrier particle mainly consists of magnetized particles and resin. To improve the resolution and tone reproductivity, it is desirable that the particle diameter be made into a globular shape with a weight average particle diameter of 100 μm preferably more than 5 μm and less than 50 μm. When the particle diameter exceeds 50 μm, especially 100 μm, it may impede to attain a thin layer of developer, and may also deteriorate developing characteristics resulting in a poor picture quality. Also, when the particle diameter is less than 5 μm, it may often deteriorate the developing characteristics of the developer, frictional electrification and fluidity, and, further, carrier scattering may easily be caused.

Also, to prevent the carrier from sticking to the surface of the latent image-carrying member caused by the injected electric charge of the bias voltage and to prevent the disappearance of the electric charge, it is preferable that the specific resistance of the carrier is made to more than $10^8\Omega$cm preferably more than $10^{13}\Omega$cm, and most preferably more than $10^{14}\Omega$cm.

Such a carrier can be made by covering the surface of the magnetic material with a resin, or by uniformly dispersing magnetic material in a suitable resin and then by classifying the particles thus obtained by means of a known classifying process.

Further, the following procedures are used to make carrier particles into a globular shape:

1 Resin coated carrier: Select a magnetic material with a globular-shape.
2 Magnetic powder distributed carrier: A globular shaped particles distributed resin is formed by means of the globular shape processing method using hot air or hot water after the globular shaped particle distributed resin process has been performed or directly by means of the spray dry method.

It is desirable that the said toner and carrier be mixed together at a ratio with which the total sum of the surface area of each of them becomes equal to each other.

For example, when the average diameter of the toner is made 8 μm, specific gravity, 1.2 $g/cm^3$, and the average particle diameter of the carrier is 20 μm, specific gravity, 4.5 $g/cm^2$, it is preferable that the toner density (the weight ratio of the toner with respect to the total amount of developer) be set to 5 wt % to 40 wt %, and more preferably 8 wt % to 25 wt %.

Namely, in the developer in accordance with the invention, different from a conventional developer in which many small particle toner attached to the outer circumference of carrier with a large particle diameter, the said developer contains carrier and toner particles of which diameter is nearly same. Thus, it is preferable that the mixing ratio of the toner and carrier be made so that the total sum of the surface area of each of them becomes equal.

In accordance with another preferred embodiment of the invention, a development device with a developer container incorporating a conductive member having substantially the same potential as that of the said container is preferably used.

In a conventional electrophotographic copier, it is normal for the regular development that a D.C. bias that is sufficient enough to remove fog on the ground area of pictorial image, namely, a D.C. bias of less than 200 V is applied to the sleeve of the development unit. Also, in an electrophotographic printer, when forming a pictorial image by scanning the original by means of a pickup element and by performing the reversal development of a latent image to be formed based on the acquired data, a potential that is almost the same as that of the non-exposure area of the image forming material, namely, a high D.C. potential bias of 300 V to 1,000 V is applied to the sleeve of the development device.

Also, a specially high voltage bias may, in some case, be applied to the sleeve of the developmental unit. Namely, instead of the development by rubbing a sensitive material with magnetic brush made of a developer, the development may, in some case, be performed by selectively scattering the toner over the image forming material while keeping the developer in non-contacting state with the image forming material. In such case, applying a high pressure bias including an A.C. component to the sleeve can be effective. Although an optimum voltage of the said high pressure voltage may vary depending on such conditions as the kinds of developers, development gap, and the thickness of the developer layer, normally, more than 500 V is required. Such developing method is referred to as non-contacting developing method.

As described above, the voltage may vary depending on the kind of development but in any case, a relatively high voltage bias needs to be applied to the sleeve. To prevent the noise signal arising from the said high voltage bias from propagating to image forming units other than the developing unit, conventional developing units are equipped with a developer container made of a conductive material that is grounded. Such a conventional developing unit has, however, a problem that discharge lightening can occur between the sleeve to which a high voltage bias is applied, developer amount controlling member arranged near the said sleeve, developer stirring member, and developer removing member thereby greatly affecting image formation.

Figure 15:
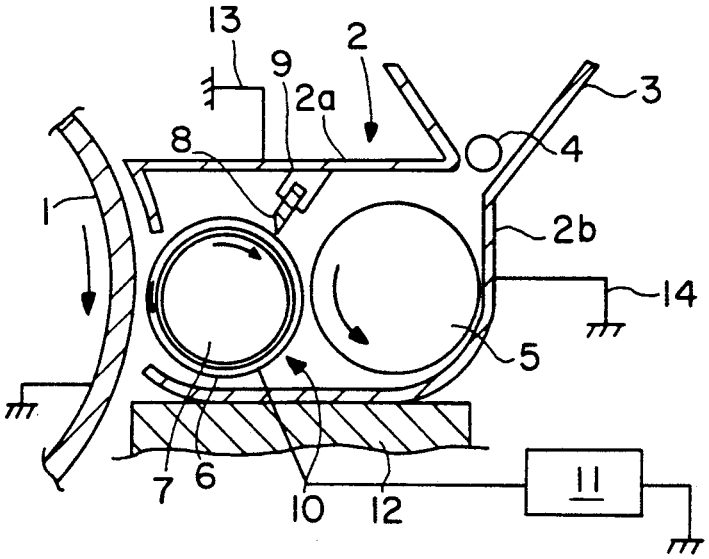
FIG. 15 is a cross sectional view of a conventional developing device.

To give a better understanding of such problem inherent in the conventional technology, a further explanation is made by referring to the developing unit shown in FIG. 15. In the diagram, numeral 1 is an image forming material that rotates in the arrow direction, numeral 2, a developer container consisting of an upper cover 2*a* and a lower cover 26, numeral 3, a container that replenishes toner to the said container 2, numeral 4, a supply roller, numeral 5, a developer stirring member that rotates in the arrow direction, numeral 6, a sleeve that rotates in the arrow direction, numeral 7, a magnetic roll that rotates in the opposite direction of the arrow. Numeral 8 is a developer layer thickness controlling member, numeral 9, a member that fixes the said controlling member 8 numeral 10, developer removing member, numeral 11, a bias power supply numeral 12, a conductive frame on which the development unit is mounted, numeral 13, wiring that grounds the upper cover 2*a*, numeral 14, wiring that grounds the lower cover 2*b*. In the aforementioned developing unit, both the upper cover 2*a* and the lower cover 2*b* of the developer container 2 are made of such metals as aluminum, copper, and iron and are grounded. (refer to numerals 13 and 14.) Also all of the above-mentioned developer layer controlling member 8, developer stirring member 5, and developer removing member 10 are made of such conductive materials as metal and are floating in a state in which they are isolated from other units. These members, however, must be arranged near the sleeve 6 to perform their characteristic function. Noter that when a non-contacting development method is employed, the said layer thickness controlling member 8 is arranged especially near sleeve 6 because the developer layer is made to a thin layer with a thickness of less than several hundred μm.

Figure 7:
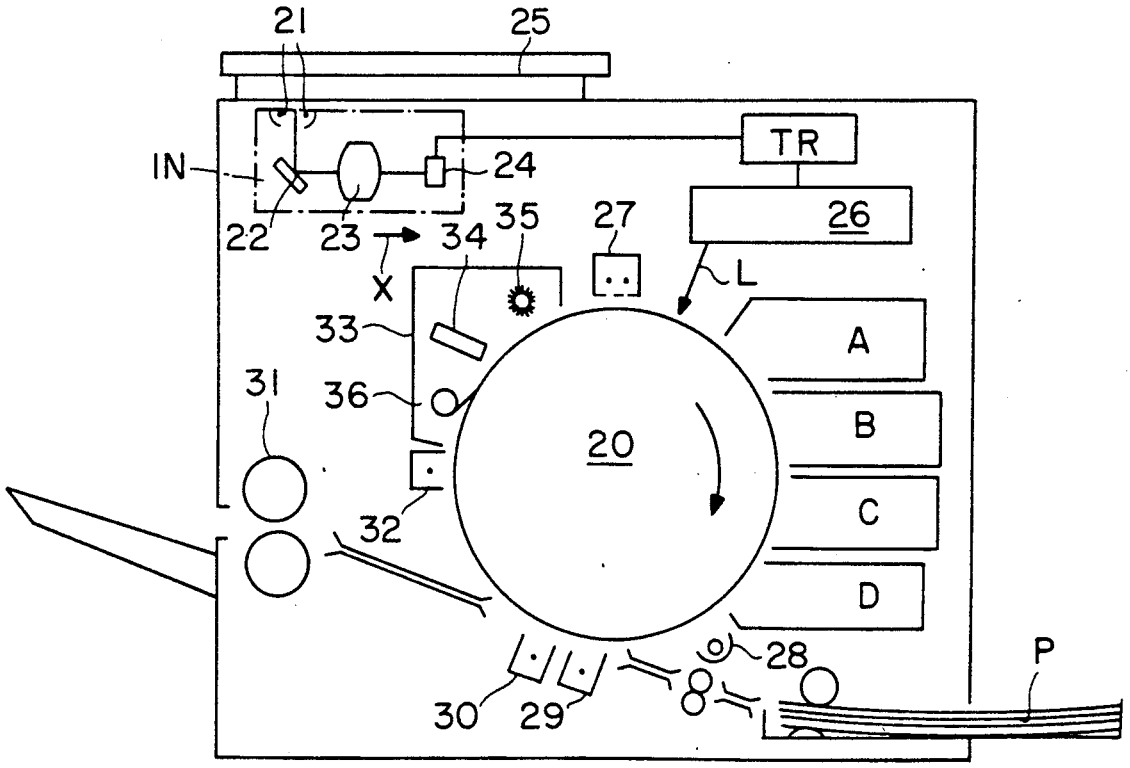
FIG. 7 is a cross sectional view of a copier used in a further embodiment of the present invention.

In the developing unit of this kind, despite developer container 2 grounded and sealed, discharge lightening can occur between sleeve 6, developer stirring member 5 arranged near the said sleeve 6, developer removing material member 10, and developer layer thickness controlling member 8. The noise that momentally occurs in such a case often causes a malfunction in the image forming unit or often stop it. Especially, in the case of a multi-colored image forming with plural developing units as shown in FIG. 7, there are many noise generating sources that give rise more serious problems in practice.

In the preferred embodiments of developing unit of the invention, such conductive members as developer container 2, developer stirring member 5 developer layer thickness controlling member 8, developer removing member 10, and sleeve 6 are structured so that they have substantially the same electric potential. For example, if a high voltage bias is being applied to sleeve 6, a similar high voltage bias is also applied to each aforementioned conductive member thereby preventing the occurrence of discharge lightening between the sleeve 6 and these conductive members leading to the avoidance of the stoppage of the image forming unit or a malfunction in the unit. Note that in the developing unit of the invention, it is desirable that the upper cover 2*a* and the lower cover 2*b* that constitute the conductive portion of the image forming unit main body and the developer container 2 of the developing unit be isolated from each other with a sufficient distance to prevent the propagation of noise signal arising from a high voltage bias.

Figure 13:
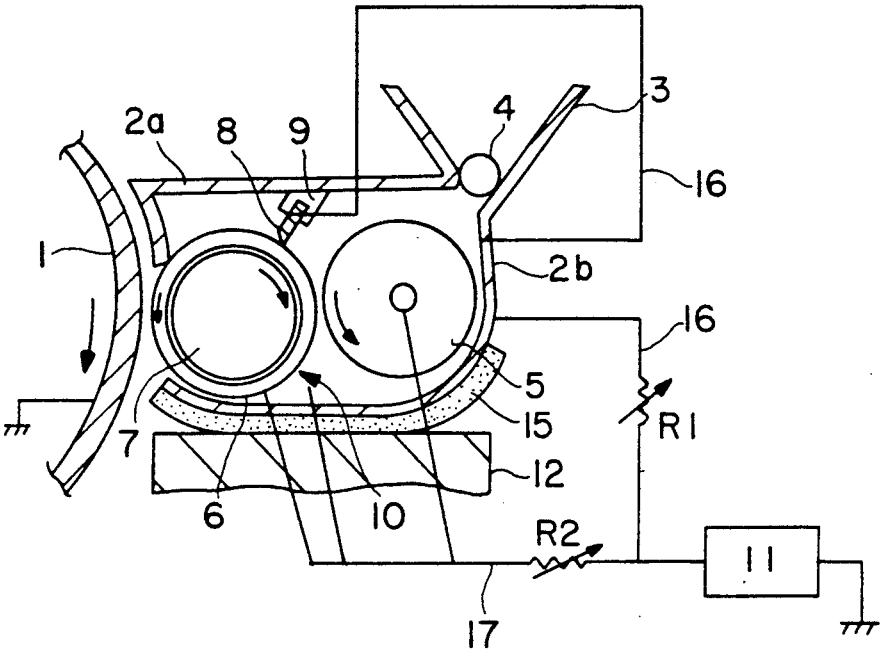
FIG. 13 shows a cross sectional view of a developing device of a preferred embodiment of the present invention.

In the detailed description of the preferred embodiment of developing unit of the invention presented below, reference is made to FIG. 13 in which: Like reference marks denote like elements in FIG. 15, numeral 15 is an insulation member, numeral 16, wiring that connects developer layer thickness controlling member 8, upper case 2*a* and lower case 2*b* to bias power supply 11, numeral 17, wiring that connects sleeve 6, developer removing member 10 and stirring member 5 to bias power supply 11. R1 and R2 are variable resistances that fine tune the voltage to be applied to each conductive member mentioned above as necessary. The bias voltage to be applied to each conductive member mentioned above is not necessarily to the same as that applied to the sleeve; if the bias voltage is in the range that prevents discharge lightening from occurring, namely, if it is substantially the same as that applied to the sleeve, it will suffice for the need. Note that cover 2b is separated from conductive frame 12 with a distance of more than 1 mm and an insulation member 15 in between. A similar insulation measure will be applied to cover 2a when necessary.

EXAMPLES

The invention, and its objects and advantages will become more apparent in the detailed description of the preferred embodiment presented below.

EXAMPLE 1

FIG. 3 shows a cross sectional view of the structure of an embodiment of the image forming unit of the invention. A document image irradiated by illumination light source 21 is applied to image forming material 20 which is evenly electrified through mirrors 22 and lens 23 whenever the document table is moved. Thus an electrostatic latent image is formed. This electrostatic latent image is developed by means of electrostatic unit A. The toner image thus obtained is transferred to a recording paper P by means of transfer electrode 29 after its electrification has been removed. The recording paper P is separated from image forming material 20 by means of separation electrode 30 and is then fixed by means of fixing unit 31. On the other hand, image forming material 20 is cleaned by means of electrification removing electrode 32 and cleaning unit 33. The numeral 36 is a roller that collects the toner removed by blade 34.

The aforementioned image forming process of the copier shown in FIG. 3 is developed by means of the developer prepared in accordance with the prescription below and with it, an image is formed.

| (Developer prescription) | |
|---|---|
| Toner constituents: | |
| Polystyrene | 25 wt % |
| Polymethacrylate | 64 wt % |
| Varifast (Electrification controlling agent) | 0.5 wt % |
| Coloring agent (Carbon black) | 10.5 wt % |

Specific gravity: 1.2 g/cm
Average particle diameter: 8 μm
Resistance ratio: More than $10^{14}\Omega$cm A desirable toner can be obtained by mixing, kneading, and dividing the aforementioned constituents.

Carrier constituents (resin coated):
Core: Ferrite
Coating resin: Styrene-acrylic acid ester copolymer (4:6)
Magnetization: 27 emu/g
Particle diameter: 30 μm
Specific gravity: 5.2 g/cm$^3$
Specific resistance: More than $10^{13}\Omega$cm A desirable globular-shaped particles carrier can be obtained by mixing, kneading, classifying and thereafter treating the above-mentioned constituents in the hot air.

Next, an intended developer is obtained by sufficiently mixing the aforementioned carrier 88 wt % and toner 12 wt %.

The developing conditions when each operating unit operates to form an image in the aforementioned image forming process by using the above-mentioned developer D are as described in Table 1 below.

TABLE 1

| | |
|---|---|
| Image forming material | Se photoconductive material (100 ϕ drum) |
| Linear speed of the image forming material | 100 mm/S |
| Surface potential | +800 V (dark area - Ov (bright area) |
| Sleeve diameter | 25 mm |
| Sleeve linear speed | 25 mm/s (in regular direction) |
| Total number of poles in the magnetic roll | 8 poles |
| Magnetic roll revolving speed | 1200 r.p.m. |
| Development gap | 500 μm |
| Developer layer thickness | 400 μm (Maximum value) |
| Developer toner density | 12 wt % |
| Amount of electric charge given to toner | −30 μc/g (average) |
| Amount of toner attached to the surface of sleeve | 0.3 mg/cm$^2$ |
| D.S. bias | 0−+100 V |
| A.C. bias | 1-2 kvp-p (2 kHz) |

When development was performed under the aforementioned conditions, a pictorial image with a sufficient image density and resolution without fog or carrier attached to it was obtained. The developmental bias was also noted to be excellent by remaining within the range of data shown in Table 1. Stable developmental characteristics without any noticeable change were observed. Further, the contamination caused by the scattering of developer inside the machine at this time was noted to be immaterial.

Next, similar development was performed under the conditions of the Table 2 by means of the aforementioned image forming process using the same developer D.

TABLE 2

| | |
|---|---|
| Image forming material | Se photoconductive material (140 ϕ drum diameter) |
| Linear speed of the image forming material | 60 mm/s |
| Surface potential | 800 V (dark area) - 0 V (bright area) |
| Sleeve diameter | 20 mm |
| Sleeve linear speed | 180 mm/s (in regular direction) |
| Total number of poles in the magnetic roll | 8 poles |
| Magnetic roll revolving speed | 800 r.p.m. |
| Developmental gap | 500 μm |
| Developer layer thickness | 400 μm (maximum value) |
| Developer toner density | 12 wt % |
| Amount of toner electric | −30 μc/g (average) |
| Amount of toner attached to the surface of sleeve | 0.3 mg/cm$^2$ |
| D.C. bias | 0 V−+100 V |
| A.C. bias | 1-2 kvp-p (2 kHz) |

The copy image formed and developed under the above-mentioned conditions was excellent in quality as well as the one obtained under the conditions described in the Table 1.

EXAMPLE 2

FIG. 6(*a*) is a cross sectional view of the structure of the image forming unit of the invention. The image input unit IN consists of an illumination light source 21 a mirror 22, a lens 23, and a primary color CCD pickup element 24 all of which are incorporated into one unit. The image input unit IN moves in the arrow direction by means of a driving unit (unshown) and the CCD pickup element 24 reads document 25.

An alternative method is to move the document 25 by moving the document table.

Image information read by the image input unit IN is converted into data suitable for recording by means of the image processing unit TR.

Laser optical system 26 forms a latent image on image forming material 20 based on the above-mentioned pictorial image data, and this latent image is developed and a toner image is formed on the image forming material 20. The surface of image forming material 20 is evenly electrified by means of electrification electrode 27. Next, an image exposure L in accordance with the recording data of laser optical system 26 is applied to the image forming material 20 via the lens. Thus an electrostatic latent image is formed. This electrostatic latent image is developed by means of the developing unit A that accommodates an yellow toner.

The toner image thus obtained is transferred on the recording paper P by means of transfer electrode 29 after its electrification has been removed. The recording paper P is separated from the image forming material 20 by means of separation electrode 20 and is fixed by means of fixing unit 31. In the meantime, the image forming material 20 is cleaned by means of electrification removing electrode 32 and cleaning unit 33.

The cleaning unit 33 is provided with a cleaning blade 34. Numeral 36 is a roller that collects the toner removed by blade 34.

Laser optical system 26 is shown in FIG. 6(*b*), in which numeral 37 is a semiconductor laser oscillator, numeral 38, a revolving multisided mirror, and numeral 39, an fo lens.

The aforementioned image forming process of the copier shown in FIG. 6(*a*) employs a reversal development using a developer prepared under the following prescription. An image is formed under the image forming conditions described in Table 1.

| (Developer Prescription) | |
|---|---|
| Toner constituents: | |
| Polystyrene | 25 wt % |
| Polymethylmethacrylate | 64 wt % |
| Varifast (electrification controlling agent) | 0.3 wt % |
| Coloring agent (carbon black) | 10.5 wt % |

Specific gravity: 1.2 g/cm$^3$
Average particle diameter: 9 μm
Specific resistance: More than $10^{14}\Omega$ A desirable toner can be obtained by mixing, kneading, and classifying the aforementioned constituents.

Carrier constituents (resin coated carrier)
Core: Ferrite
Coating resin: Styrene-acrylic acid ester copolymer (4:6)
Magnetization: 27 emu/g
Particle diameter: 32 μm
Specific gravity: 5.2 g/cm$^3$
Specific resistance ratio: More than $10^{13}\Omega$cm Next, an intended developer D is obtained by sufficiently mixing the aforementioned carrier 88 wt % with toner 12 wt %

The developing conditions when each operating section operates to form an image in the aforementioned image forming process by using the above-mentioned developer D are as described in Table 3 below.

TABLE 3

| | |
|---|---|
| Image forming material | Organic photoconductive material (100 ϕ drum diameter) |
| Linear speed of the image forming material | 150 mm/s |
| Surface potential | −700 V (Nonexposure area)<br>−50 V (Exposure area) |
| Sleeve diameter | 30 mm |
| Sleeve linear speed | 250 mm/s (in regular direction) |
| Total number of poles n the magnetic roll | 12 poles |
| Magnetic roll revolving speed | 1000 r.p.m. |
| Developmental gap | 600 μm |
| Developer layer thickness | 400 μm (Maximum value) |
| Developer toner density | 12 wt % |
| Amount of electric charge give to toner | −30 μc/g (average) |
| Amount of toner attached to the surface of the sleeve | 0.4 mg/cm$^2$ |
| D.C. bias | −500 v−−600 v |
| A.C. bias | 1-2.5 kvp-p (3 kHz) |

When development was performed under the aforementioned condition, a toner image with a sufficient image density and resolution without fog or carrier which tends to occur in reversal development, was obtained. The developmental bias was also noted to be excellent by remaining within the range of the data shown in Table 3. Stable developmental characteristics without any noticeable change were noted despite operation for a long time while replenishing toner when necessary.

Further, contamination caused by the scattering of developer inside the machine at this time was noted to be immaterial.

Next, a similar development was performed under the conditions of Table 4 by means of the aforementioned image forming process using the same developer D.

TABLE 4

| | |
|---|---|
| Image forming material | Organic photoconductive material (140 ϕ drum diameter) |
| Linear speed of the image forming material | 60 mm/s |
| Surface potential | −700 V (Nonexposure area)<br>−50 V (Exposure area) |
| Sleeve diameter | 20 mm |
| Sleeve linear speed | 250 mm/s (in regular direction) |
| Total number of poles magnetic roll | 8 poles |
| Magnetic roll revolving speed | 1000 r.p.m. |
| Developmental gap | 500 μm |
| Developer layer thickness | 400 μm (Maximum value) |
| Developer toner density | 12 wt % |
| Amount of electric charge given to toner | −30 μc/g(average) |
| Amount of toner attached to the surface of sleeve | 0.4 mg/cm$^2$ |
| D.C. bias | −500−−600 V |
| A.C. bias | 1-2.5 kvp-p (2 kHz) |

The copy image created and developed under the above mentioned conditions was excellent in quality as well as the one obtained under the conditions described in the Table 3.

EXAMPLE 3

FIG. 7 shows the structure of an image forming unit of the invention. The image input unit IN consists of an illumination light source 1, a mirror 22, a lens 23, a primary color CCE pick-up element 24 all of which are incorporated into one unit. The image input section IN moves in the arrow direction by means of a driving unit (unshown), and the CCD image pickup element 24 reads document. An alternative method is to move document 25 by fixing the image input unit IN and by moving the document table.

Image information read by the image input unit IN is converted into data suitable for recording at the image processing unit TR.

Laser optical system 26 forms a latent image on image forming material 20 based on the above-mentioned pictorial image data, and this latent image is developed and a toner image is formed on the image forming material 20. The surface of image forming material 20 is evenly electrified by means of scorotron electrification electrode 27. Next, an image exposure L.

In accordance with the recording data of laser optical system 26 is applied to the image forming material 20 through the lens. Thus an electrostatic latent image is formed. This electrostatic latent image is developed by means of the developing unit A that accommodates an yellow toner. The image forming material 20 on which a toner image was formed is evenly electrified again by means of electrification electrode 27, and receives an image exposure L in accordance with the recording data of a different color constituent. The electrostatic latent image formed is developed by means of a developing unit B that accommodates a magenta toner. As a result, a 2-tone color toner image consisting yellow and magenta toners is formed on the image forming material 20. This is to be repeated in the following; cyan and black toners are developed laying one on top of another, thereby forming a 4-tone color toner image on the image forming material 20. Note that all of the developing units A, B, C, and D that accommodate the above-mentioned different colored toners have the same structure as that of the developing unit shown in FIG. 1.

The multi-colored toner image thus obtained is transferred onto the recording paper P by means of the transfer electrode 29 after its electrification has been removed. The recording paper P is separated from the image forming material 20 by means of separation electrodes 30 and is then fixed by means of the fixing unit 31. In the meantime, the image forming material 20 is cleaned by means of electrification removing electrode 32 and cleaning unit 33.

The cleaning unit 33 is provided with a cleaning blade 34 and a fur brush 35. These units are kept from coming into contact with the image forming material while an image is being formed but when a multi-colored image is formed on the image forming material 20, then will come into contact with it to remove the remnant of the toner used for transfer. Thereafter, the cleaning blade 34 separates from the image forming material 20, and the fur brush also separates from it a little later. When the cleaning blade 34 separates from the image forming material 20, the fur brush 35 removes the toner remaining on the image forming material 20. Numeral 36 is a roller that collects the toner removed by the blade 34.

Laser optical system 26 is shown in FIG. 6 (*b*), in which numeral 37 is a semiconductor laser oscillator, numeral 38, a revolving multisided mirror, numeral 39, an f0 lens.

In an image forming unit of this kind, setting the timing to start image exposure by putting an optical mark on the image forming material to position each pictorial image so that it can be read by an optical sensor is effective.

Figure 8:
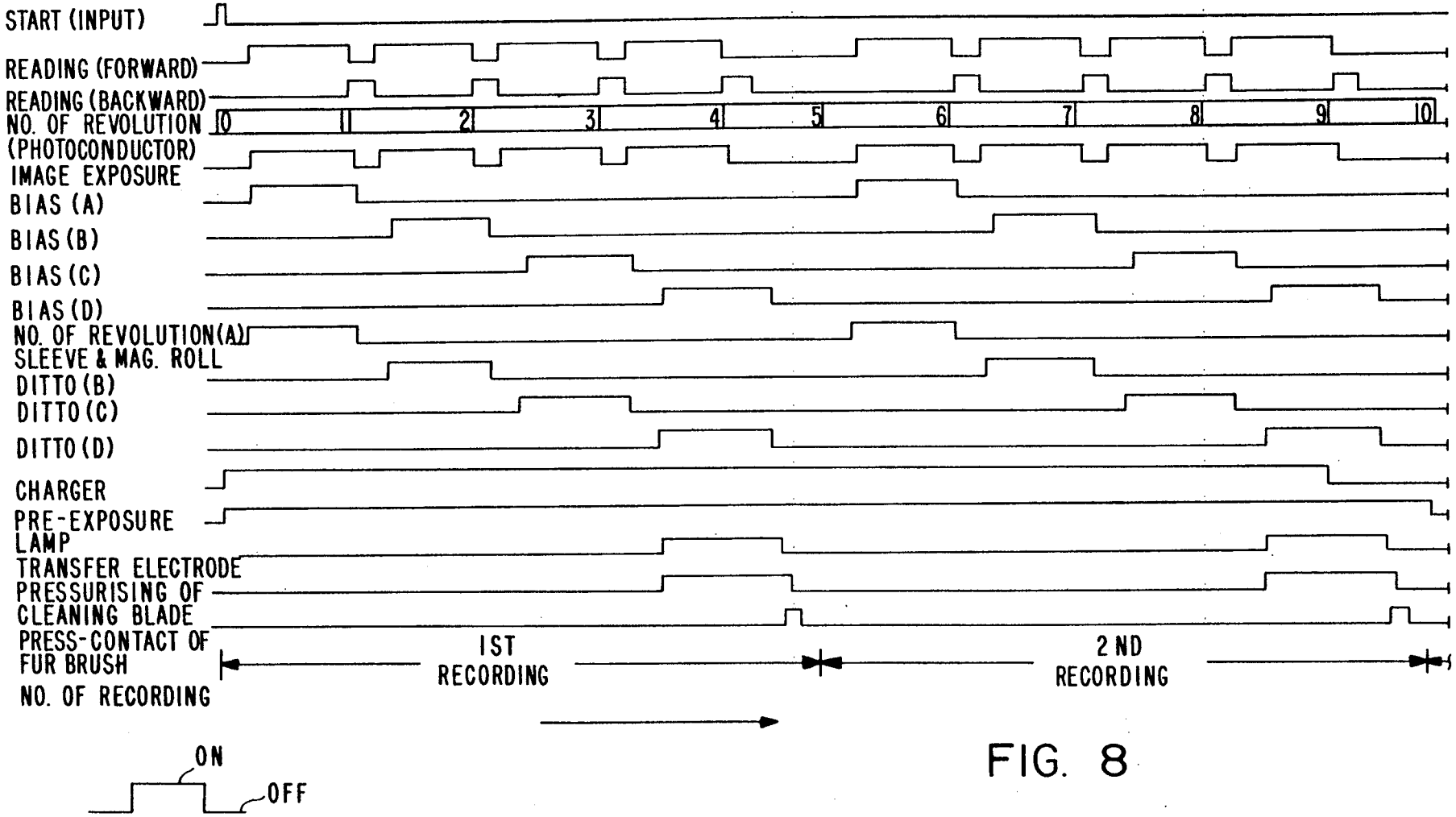
FIG. 8 is a diagram that shows an operating timing of an image formation device in the embodiment shown in FIG. 7.
Figure 9:
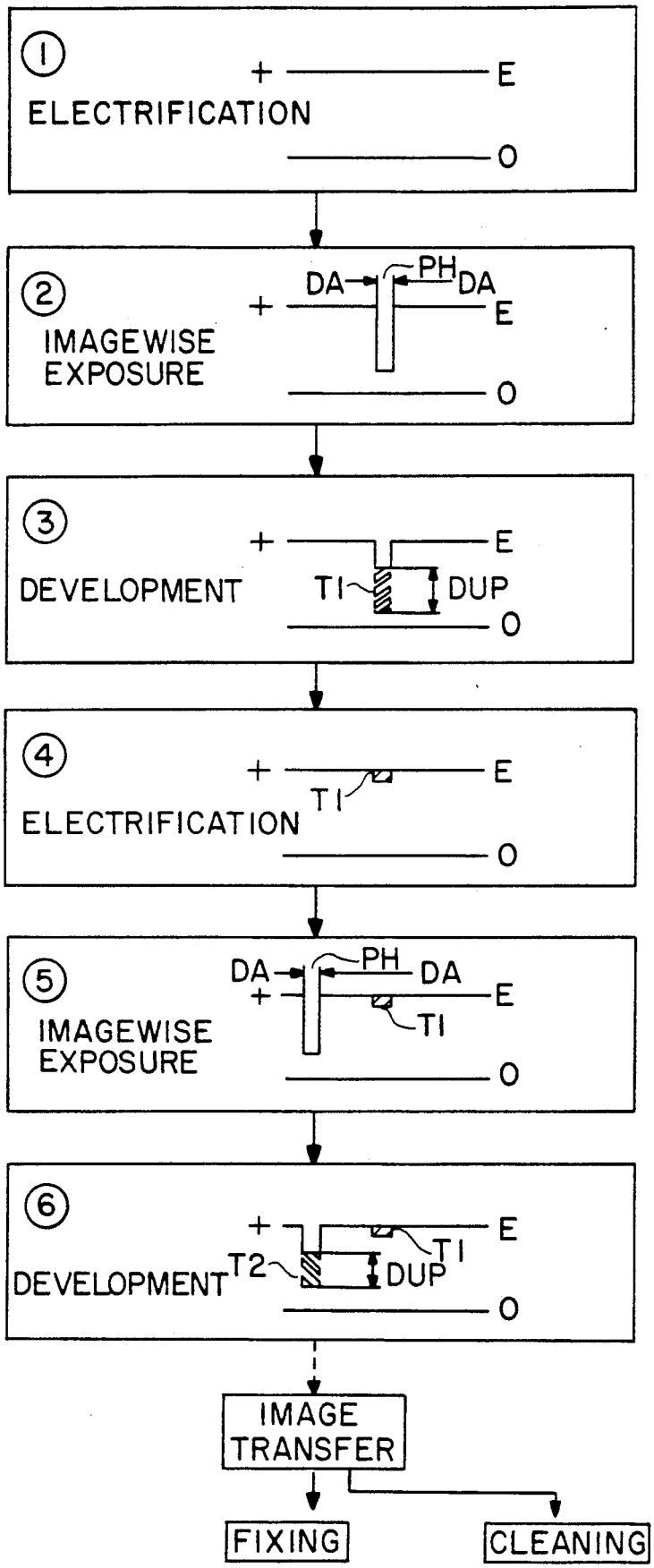
FIG. 9 is a flow chart of an image formation device.

The above-mentioned image forming process in the copier shown is FIG. 7 is developed by means of the reversed developmental method as shown in FIG. 9 by using a developer prepared in accordance with the prescription below. Further, an image is formed under the image forming conditions described in Tables 2 through 4 and the operating timing described in FIG. 8. (FIG. 8 shows an operating status at the High level.)

| (Developer Prescription) | |
|---|---|
| Toner constituents: | |
| Polystyrene | 45% |
| Polymethymethacrylate | 44% |
| Varifast | 0.2 wt % |
| (Electrification controlling agent) | |
| Coloring Agent | 0.15 wt % |

Among coloring agent, yellow toner is made of Auramine; magenta toner, rhodamine B; cyanine toner, copper-phthalocyanine; black toner, carbon black. An intended toner is obtained by mixing, kneading, and dividing the above-mentioned constituents.

Carrier(resin coated carrier) constituents

Core: Ferrite

Coating resin: Styrene-acrylic acid ester copolymer(4:6)

Magnetization: 27 emu/g

Particle diameter: 30 $\mu$m

Specific gravity 5.2 g/cm$_3$

Specific resistance : More than $10^{13}\Omega$cm

An intended carrier having a globular shape can be obtained by mixing, kneading, classifying and thereafter treating in the hot air the above-mentioned constituents.

Next, an intended developer is obtained by sufficiently mixing 88 wt % of aforementioned carrier with 12 wt % of each different color toner.

In the first embodiment adapted to use the aforementioned image forming process and the said developer, the developing conditions when each operating unit operates to form an image are as shown in Tables 5 to 8.

TABLE 5

| Image forming material and developer unit | | Condition |
|---|---|---|
| Image forming material | Sensitive layer | Organic photoconductive material |
| | Drum diameter | 140 mm |
| | Linear speed | 60 mm/sec |
| Electrification | Nonexposure potential | −700 V |
| | Exposure area potential | −50 V |
| Image exposure L | Light source | Semiconductor laser |
| | Wave length | 780 nm |
| | Recording density | 16 dots/mm |
| Developer unit | Sleeve | Diameter 20 mmϕ |
| All of A, B, C and D developer units | linear speed | 250 mm/S |
| | Magnetic roll | 8 poles 800 r.p.m. |
| | Magnetic flux density (maximum) on the surface of sleeve | 700 G |

TABLE 6

| Condition Developer | Average particle diameter μm | Specific gravity g/cm³ | Specific resistance Ωcm | Amount of electrification μc/g | Toner density wt % |
|---|---|---|---|---|---|
| Carrier | 30 | 5.2 | More than $10^{14}$ | Resin coated ferrite particle with magnetization 40 e.m.u/g | |
| Toner | | | | | |
| Yellow | 8 | 1.2 | More than $10^{14}$ | −20 | 12 |
| Magenta | 8 | 1.2 | More than $10^{14}$ | −20 | 12 |
| Cyan | 8 | 1.2 | More than $10^{14}$ | −20 | 12 |
| Black | 5 | 1.2 | More than $10^{14}$ | −25 | 10 |

TABLE 7

| Development | Condition D.C. | | Condition A.C. |
|---|---|---|---|
| Bias at the time of development | | | |
| Yellow development | −500 V | 2 KHz (Frequency) | 1.2 KV (between peaks) |
| Magenta development | −500 V | 2 KHz | 1.2 KV |
| Cyan development | −500 V | 2 KHz | 1.2 KV |
| Black development | −500 V | 2 KHz | 1.2 KV |
| Bias during non-developing (Note) | | | |
| Applies to development of all different colors (Magnetic toll and sleeve stop) | 0 V | More than 0.3 KV at 2 KHz | |
| Developing gap | (Common to all developing units) 0.3 mm | | |
| Developer layer thickness in the developing area | (Common to all developing units) 50 μm | | |
| Order of development | (Yellow) → (Magenta) → (Cyan) → (Black) | | |

(Note)
During nondeveloping, the sleeve may be made to be in a status in which it is electrically floating.

TABLE 8

| (Manner of other processes) | |
|---|---|
| Image transfer | By means of corona discharge |
| Fixing | Heat roll fixing |
| Cleaning | Blade and fur brush cleaning |

Note that the organic photoconductive material described in Table 5 comprises a function-division sensitive layer consisting of a carrier generation layer containing trisazo pigment as its lower layer and a carrier transport layer containing aromatic amino compounds as its upper layer. Such an organic sensitive layer is used for the noncontacting developing method that employs the reversal developing method.

Also, in the timing chart shown FIG. 8, the lateral axis shows the image forming process, and the vertical axis shows each image forming unit. Characters A, B, C, and C show an yellow toner developing, cyan toner developing, and black toner developing units respectively.

A multi-colored image created under the aforementioned conditions was found to have an excellent resolution and a superior pseudo half-tone reproductivity by means of dots. The scattering of toner and carrier was also suppressed to a minimum.

Figure 10:
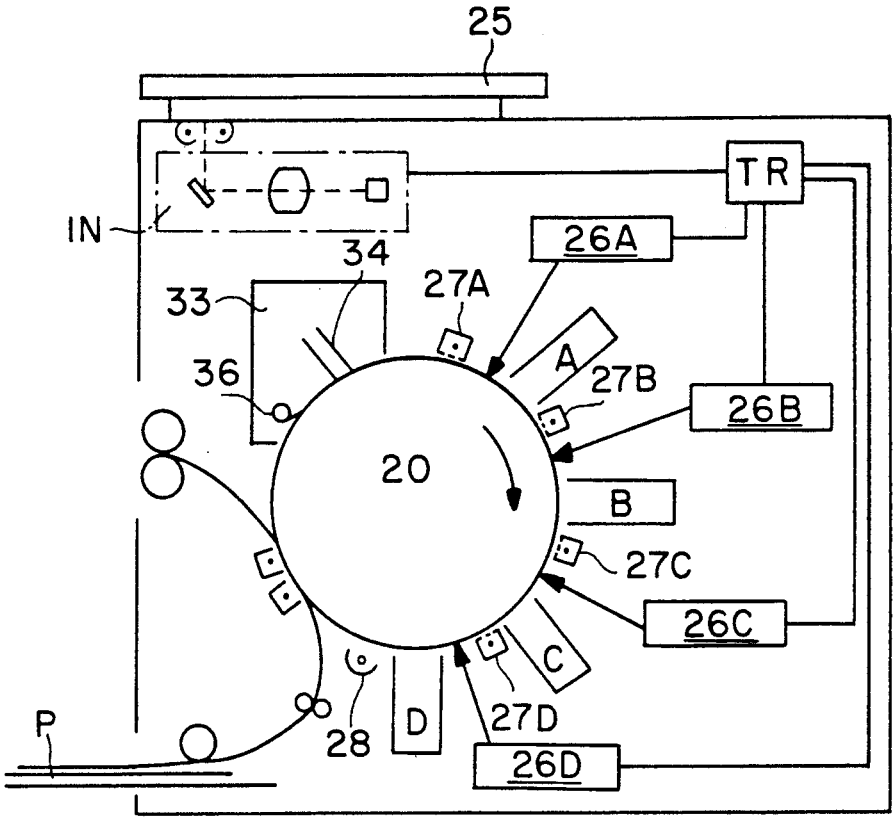
FIG. 10 is a cross sectional view of a copier used in a still another embodiment of the present invention.

FIG. 10 is a cross sectional view of the principal portions of an image forming unit designed to create a multicolored image within a period in which the image forming material makes one revolution. In FIG. 7, like reference numerals denote members with the same function. The differences between the image forming units shown in FIGS. 10 and the one shown in FIG. 7 are as follows:

(1) In FIG. 10, the upstream side of each developing unit of A, B, C, and D installed on the peripheral of image forming unit 20 is provided with an electrification electrode of 27A, 27B, 27C, and 27D respectively and such a semiconductor laser as 26A, 26B, 26C, and 26D respectively.

(2) Cleaning unit 33 consists of a toner removing blade 34 and a toner collecting roller 36, and the toner blade 34 is always pressed to make contact with image forming material 20.

(3) The peripheral of the image forming material 20 with a turn system carrying path of recording paper P was designed to be capable of being mounted with many units. The above-mentioned points are only the different points in which these two image forming materials differ form each other. When attempting to form a 4-color image by means of the image forming unit mentioned above, even if the linear speed in the peripheral surface of the image forming drum made to be the same as that of the image forming drum illustrated in FIG. 7, the image forming speed can be increased about four times.

Next, a multicolored image was formed under the conditions shown in Tables 9 and 10 by means of a image forming unit shown in FIG. 10 as a similar preferred embodiment of the invention.

TABLE 9

| Image forming material and developer unit | | Condition |
|---|---|---|
| Image forming material | Sensitive layer | Organic photoconductive material |
| | Drum diameter | 140 mm |
| | Linear speed | 200 mm/s |
| Electrification | Nonexposure potential | −700 V |
| | Exposure area potential | −50 V |
| Image exposure L | Light source | Semiconductor laser |
| | Wavelength | 780 nm |
| | Recording density | 16 dots/mm |
| Developer unit | Sleeve | Diameter 20 mmϕ |
| All of developer units of A, B, C, and D | Linear speed | 500 mm/s |
| | Magnetic roll | 8 poles 1500 r.p.m. |
| | Magnetic flux density (maximum) on the surface of sleeve | 700 G |

TABLE 10

| | |
|---|---|
| Image transfer | Corona discharge system |
| Fixing | Heat roll fixing |
| Cleaning | Blade and fur brush are used |

A multicolored image created under the aforementioned conditions was found to have a high resolution, superior color tone and tone reproductivity without accompanying the scattering of toner and carrier as in the case of the first embodiment of this example.

Further, as a similar example, an image was formed under the conditions described in the Tables 9 and 10 by using a device illustrated in FIG. 7. (Other conditions are the same as those described in the example 3.) The test also produced good results.

EXAMPLE 4

Figure 11:
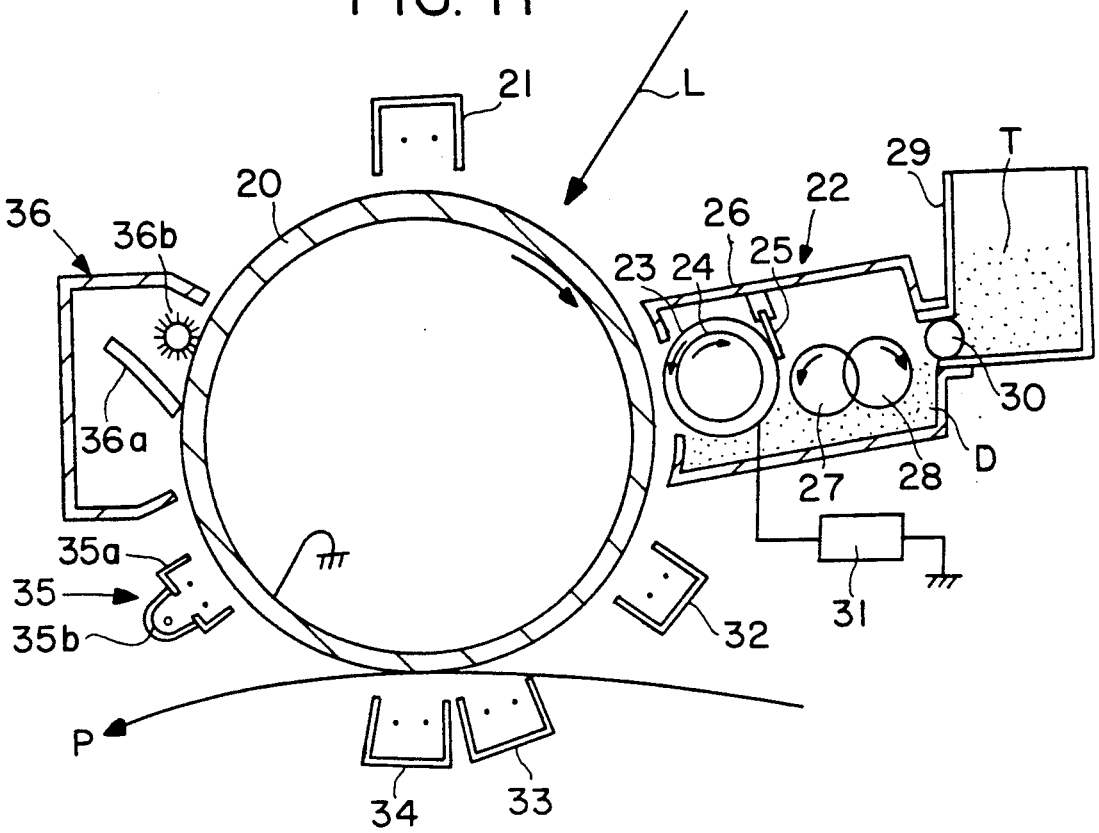
FIG. 11 is a cross sectional view of a copier used in a still another embodiment of the present invention.

FIG. 11 is a cross sectional view of the principal portions of the image forming unit used to explain the embodiment of the invention. In the diagram, numeral 1 is an image forming material that rotates in the arrow direction, numeral 21, a corona electrification unit, L, an image exposure, numeral 22, a developing unit with the same structure as that illustrated in FIG. 1, numeral 32, transcription front exposure lamp, numeral 33, a transcription electrode, numeral 34, a separation electrode, character P, a transcription paper, numeral 35, a cleaning electrification removing unit consisting of an electrification removing lamps 35*a* and 35*b*. Numeral 36, a cleaning unit equipped with a cleaning blade 36*a* and bias roller 36*b*.

This unit forms an image in the following manner: An electric charge is applied to the surface of image forming material 1 to attain a uniform potential on the surface of image forming material 1 by means of a corona electrification unit 21, and a latent image is subsequently formed by applying an exposure light L to it. This latent image is developed under the conditions which will be described later and a toner image is subsequently obtained. This toner image is transferred on the transfer paper P transported at a predetermined timing by virtue of transcription electrode 33 after a uniform exposure has been applied to it by means of transcription front exposure lamp 32. The transfer paper P is separated from image forming material 1 by virtue of separation electrode 34, and the toner image transferred by means of the fixing unit (unshown) is fixed on the transfer paper P and is subsequently ejected to the outside of the machine. In the meantime, the electrification of the surface of image forming material 1 after transfer is removed by means of the electrification removing electrode 35*a* of cleaning front electrification removing unit 35 and electrification removing lamp 35*b*, and the said surface of image forming material 1 is subsequently cleaned by means of the blade 36*a* of the cleaning unit 36. At this time, a bias is applied to the overflowing toner which is received by revolving bias roller 36*b*. Note that the image exposure L is produced by means of a semiconductor laser with a wavelength of 780 mm.

Next, the developer used is described.

The toner is produced as follows.

An amount of 100 wt % of polyester resin 120 p (manufactured by Kao Corporation), an amount of 6 wt % of polyrropylene 660 p (manufactured by Sanyo Kasei Co., Ltd), and an amount of 10 wt % of carbon black Mogal L (manufactured by Cabot Company) are mixed by means of the Henshel mixer, and is then left to be cooled after sufficiently mixed and kneaded by means of a 3-line roll at 140 C. The mixture is then roughly pulverized, followed by the processes of pulverization by a jet mill and division. Subsequently coloring particles with an average particle diameter of 10 μm are obtained. An amount of 0.4 wt % of hydrophoblic minute particle silica R-812 (manufactured by Japan Aerosil Company) is added to an amount of 100 wt % of these coloring particles and is then mixed by a V-type mixer. Subsequently a toner is obtained. This toner has the following principal physical property values: resistance rate; about $10^{14}\Omega$cm, average particle diameter; 10 μm, and specific gravity; 1.2 g/cm$^3$.

This carrier is produced as follows: An intended carrier is obtained by coating styrene acrylic resin with a thickness of 1.5 μm of the surface of globular-shaped manganese-zinc ferrite particle. (manufactured by TDK Company). The principal physical property values of the carrier are; average particle diameter; 30 μm, resistance ratio $10^{13}\Omega$cm magnetization; 85 emu/cm$^3$ and specific gravity; 4.6 g/cm$^3$.

An intended developer can be obtained by mixing an amount of 10 wt % of the toner with an amount of 90 wt % of the carrier. If this mixture is sufficiently stirred, an average electrification amount of the toner will become about −20 μc/g.

A summary of other image forming conditions is shown in Table 11.

TABLE 11

| Element | Condition |
|---|---|
| Image forming material | Organic photoconductive material (80 ϕ drum) |
| Linear speed | 60 mm/s (c.w.) |
| Surface potential | |
| Nonexposure area | −700 V |
| Exposure area | 0 V |
| Sleeve Diameter | 20 mm |
| Material | Nonmagnetic stainless steel (Surface 3 μm blast processed) |
| Line speed | 250 mm/s (c.c.w.) |
| Magnetic roll | |
| Total number of pole | 8 poles |
| Revolving speed | −1000 r.p.m. (c.w.) |
| Magnetic flux density on the surface of sleeve | 700 G (maximum) |
| Developmental gap | 550 μm |
| Bias | |
| D.C. | −600 V |
| A.C. | 1.5 KVp-p, 2 KHz |
| Amount of toner attached to the surface of sleeve | 0.5 mg/cm$^2$ |

Microscopic observations revealed that the largest length of the magnetic brush formed on the surface of the sleeve was 500 μm.

When development was performed by attaching toner to the low potential portion (exposure area) of the image forming material under the above-mentioned condition, a quality pictorial image without attaching carrier and for to it was obtained.

Also, when only AC bias was made to 2.6 KVp-p, the adhesion of carrier to the surface of the pictorial image was observed.

EXAMPLE 5

An image was experimentally formed by means of image forming unit shown in FIG. 11 in the similar manner applied to the example 4. The toner applied to the Example 4 was used for the experimentation and the carrier used was produced in the following manner.

An amount of 50 wt % of styrene scrylic resin (with a monomer content ratio of styrene, butylacrylate, and methylmethacrylate of 75:15:10) and an amount of 50 wt % of an iron alloy (Fe; 98 wt %: Si; 2 wt %: saturated magnetized strength; 190 emu/g.) and an amount of 2 wt % of electrification controlling agent "Nigrosine SO" (manufactured by Orient Chemical Company) are mixed by a ball mill. The intended carrier was obtained by mixing this mixture with two lines of rolls followed by the processes of pulverization and division. The principal physical property values of such a carrier are as follows: average particle diameter; 30 μm, resistance ratio; about $10^{14}\Omega$cm specific gravity; 2.4 g/cm$^3$, and magnitization strength; 60 emu/cm$^3$.

An intended developer was obtained by mixing these toner and carrier at a weight ratio of 3 to 7. When this mixture was sufficiently stirred, the average amount of toner's electrification had become $-20$ $\mu$c/g.

Other different points between the example 4 and example 5 are that the example 5's developmenting gap was made to 500 $\mu$m and the amount of toner that sticks to the surface of the sleeve made to 0.6 mg/cm$^3$. As a result, the maximum length of the magnetic brushes formed of the sleeve was noted to be 400 $\mu$m.

When development was performed by attaching the toner to the low potantial portion of the image forming material under the aforementioned condition, a quality pictorial image without attaching carrier to it was obtained.

EXAMPLE 6

An image was formed by means of a multicolored image forming unit in accordance with the present invention as shown in FIG. 7. The theory of this image formation is described by referring to a flowchart shown in FIG. 9. FIG. 9 shows changes in the surface potential of the image forming material in which pH is an exposure area of the image forming material, DA, a nonexposure area of the image forming material, DUP, a rise in potential coused by toner $T_1$ attached to the exposure area pH at the time of the first development. For the convenience of explanation, the polarity of latent image is assumed to be position.

1 A uniform electrification is applied to the image forming material by means of an electrification unit to make it attains fixed positive surface potential E.

2 The first image exposure with such things as laser, cathod-ray-tube, and LED as its exposure source is then applied, and the exposure area pH's potential decreases in proportion to its light amount.

3 An electrostatic latent image thus formed developed by a developing unit to which a positive bias that is almost equal to the surface patential E of the ninexposure area is applied. As a result, a positive electrification toner T, attaches to the exposure area pH with a relatively low potential, thereby forming the first toner image. The potential of the area in which this toner image was formed will only rise by DUP when the positive electrification toner $T_1$ attaches to it but normally its potantial does not become the same level as that of the nonexposure area DA.

4 Next the second electrification is applied to the surface of image forming material on which the first image had been formed. As a result, the surface of the image forming material attains a uniform potantial E regardless of the presence of the toner $T_1$.

5 The second image exposure is applied to the surface of this image forming material thereby forming an electrostatic latent image.

6 By repeating the procedures described in the above-mentioned item 3, the development of a positive electrification toner $T_2$ with a color different than that of toner $T_1$ is performed and thus the second toner image can be obtained.

If such similar process is repeated several times as required, a multicolored toner image can be obtained on the image forming material. Further, a multicolored recording pictorial image can be obtained by transferring this multicolored toner image to the transfer material and by subsequently fixing it through heating or applying pressure to it. In this case, the toner and electric change that remain on the image forming material are cleaned and used for the next multicolored image formation.

The multicolored image forming unit shown in FIG. 6-(*a*) operates as follows:

The image input unit IN consists of an illumination light source 16, a mirror 20, a lens 23, and a first dimensional color CCD pickup element 24 all of which are incorporated into one unit. The image input unit IN is moved in the arrow direction by means of a driving unit (unshown), and the CCE pickup element 24 reads the document.

Image information read by the image input unit IN is converted into data suitable for recording by the image processing unit TR.

Laser optical system 26 forms a latent image on the image forming material 1 based on the aforementioned image data in the following manner, and this latent image is developed and a toner image is formed on the image forming material. The surface of the image forming material 1 is made to attain a uniform electrification by means of Scorotron electrification electrode 21. Next, laser optical system 26 applies an image exposure L in accordance with the recorded data to the surface of the image forming material 1 through the lens. Thus an electrostatic latent image is formed. This electrostatic latent image is developed by the developing unit A that accommodes an yellow toner. This developing unit A has the same structure as that of the one shown in FIG. 1.

The image forming material on which a toner image was formed is made to attain a uniform electrification again by means of the Scorotron electrification electrode and subsequently received an image exposure L in accordance with the recorded data of a different color. The electrostatic latent image formed is developed by the developing unit B that accommodates a magenta toner. As a result, a 2-color toner image consisting of the yellow and magenta toners is formed on the image forming material 1. The same procedure is repeated, and cyanine and black toners are developed one on top of another thus forming a 4-color toner image on the image forming material 1. Note that all of the developing units A, B, C, and D that accommodate the aforementioned different colored toners have the same structure as that of those illustrated in FIG. 1.

A multicolored toner image thus obtained is transferred to the recording paper P by transfer electrode 33 after its electrification has been removed and made to become easily transferred. The recording paper P is separated from image forming material 1 by separation electrode 34, and is then fixed by fixing unit 31. In the meantime, the image forming material 1 is cleaned by electrification removing electrode 35 and cleaning unit 36.

The cleaning unit 36 is equipped with a cleaning blade 36*a* and a fur brush 36C. They are kept from making contact with the image forming material 1 while an image is being formed. After the formation of a multicolored image on the image forming material 1 and following the transfer of this image to the recording paper P, they come into contact with the image forming material 1, and remove the remnant of toner left after transfer. Thereafter, the cleaning blade 36*a* separates from the image forming material 1, and the fur brush 36C separate from it a little later. The fur brush 36C removes the remnant of the toner on the image forming material 1 when the cleaning blade 36*a* separates from the image forming material 1. Numeral 36*b* is a roller that collects the toner removed by the blade 36*a*.

Laser optical system 26 is shown in FIG. 6-(*b*) in which numeral 37 is a semiconductor laser oscillator, numeral 38, a revolving multisided mirror, numeral 39, an f0 lens.

The carrier used here was the same as the one used for the example 1. The black toner used was the same as the one used for the example 1, but for other toners, instead of carbon black, different coloring agents were used. Namely, for yellow toner, Auramine; for magenta toner, rhodamine; for cyan toner, copper-phthalocyanine was used. The mixing ratio between the toner and carrier was, in all cases, made to be 1 to 9 (weight ratio). Other image forming conditions were as shown in Table 12.

TABLE 12

| Element | Condition |
|---|---|
| Image forming material | Organic photoconductive material (140 ϕ drum) |
| Linear speed | 200 mm/s (c.w.) |
| Surface potential | |
| Nonexposure area | −700 V |
| Exposure area | 0 V |
| Sleeve Diameter | 20 mm |
| (Common) Material | Non-magnetized stainless steel (Surface 3 μm blast processed) |
| Linear speed | 500 mm/s (c.c.w.) |
| Magnetic roll | |
| Total number | 8 poles |
| Revolving speed | 1,500 r.p.m. (c.w.) |
| Magnetic flux density of surface sleeve (Common) | 700 G (maximum) |
| Developmenting gap (Common) | 500 μm |
| Bias | |
| D.C. | |
| Yellow | −500 V |
| Magenta | −550 V |
| Cyan | −600 V |
| Black | −600 V |
| A.C. | |
| (Common) | 1.5 KVp-p, 2 KHz |
| Amount of toner sticked to the surface of sleeve (Common) | 0.6 mg/cm$^2$ |

Note that the maximum length of all magnetic brushes formed on the surface of the sleeve was 450 μm.

A multicolored images formed under the above-mentioned conditions by developing in the order of yellow, magenta, cyanine, black were found to be a multicolored quality image without carrier and toner attached to the ground area of it.

Note that such a unit as shown in FIG. 10 can be used as an alternative to the process described in FIG. 9. Here, same numerals denote the same elements described in FIG. 7. This unit is characterized by its ability to develop a multicolored image while the image forming material makes one revolution. Namely, a latest image of the first color is formed by electrification unit 21A and image exposure unit 26A, and is then developed by developing unit A. Thereafter, the same processes are immediately performed by electrification unit B, image exposure unit 26B, and developing unit B. This will be repeated for the different colors.

In such multicolored developing units as shown in FIG. 7 and 10, the invention is especially effective.

Different color toners and carrier can be prevented from becoming mixed with one another simultaneously with very little amount of developer scattered over the sleeve thereby producing stable quality image with an excellent tone reproductivity.

This invention can also be preferably applied to a device that forms a multicolored image on the sensitive material by performing one time image exposure. Such a device forms a multicolored image in the following manner by using a sensitive material, preferably the one incorporating an insulation layer that includes a conductive layer and a filter layer consisting of plural different filters. Namely, an image is formed in accordance with the boundary surface electric charge density between the insulation layer and light conductive layer by applying an electrification and image exposure to the said sensitive material. Subsequently, a potential pattern is formed on the respective filter portion of the sensitive material by applying a total exposure with a specific light to its image forming surface, and its potential pattern is developed by the developing unit incorporating a specific color toner thereby forming a single color toner image. Next, a potential pattern is formed by means of a total exposure by using a total exposure light that is different from the previous one after the potential pattern has been smoothed by electrification. A second color toner image is then formed on the sensitive material by performing development by means of the developing unit accommodating a toner with a color different from the previous toner. Thereafter, the potential smoothing, total exposure, and development are repeated as many times as required.

Under such development, at least after the second development, an image forming method employing a noncontacting developing means is used. As a result, different color toners attach to the respective filter portions of the sensitive material and thus a multicolored image is formed (Refer to Japanese Patent Application Nos. 59-83096, 59-187014, 59-185440 and 60-229524.) According to the multicolored image forming device of this kind, one time exposure completes development thereby causing no discrepancy in color.

Also, such a variation in structure as a sensitive material installed on the conductive base material to perform an image exposure and total exposure from the filter side (Japanese Patent Application No. 59-199547) and a different structure (Japanese Patent Application No. 59-201084) can also be possible. The sensitive layer can also be structured not only a single layer but a function-division type layer consisting of an electric charge layer and an electric charge movable layer (Japanese Patent Application No. 60-245178.) Also, the sensitive material can be structured so that its sensitive layer is provided with a color disassembling function (Japanese Patent Application Nos. 59-201085 and 60-245177).

EXAMPLE 7

Figure 14:
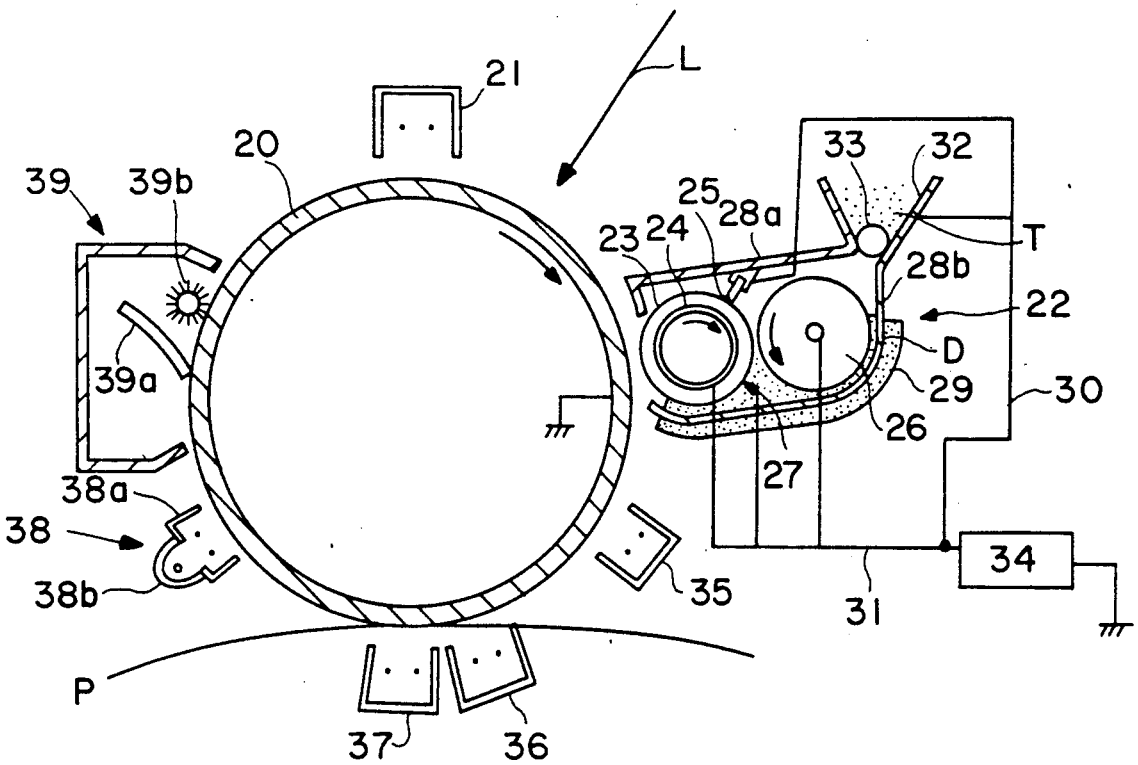
FIG. 14 shows a cross sectional view of an image formation device that employs a developing device of a preferable embodiment of the present invention.

FIG. 14 is a cross sectional view of the principal partions of a copier intended to explain the embodiment of the invention. In the said diagram, numeral 20 is a sensitive material that rotates in the arrow direction, numeral 21, a positive corona electrification unit, L, an image exposure, numeral 23, an aluminum sleeve that rotates in the arrow direction, numeral 24, a magnetic roll with 8 electrodes having N and S arranged alternately that rotates in the opposite direction of the said sleeve, numeral 25, a developer layer thickness controlling member, numeral 26, a developer stirring member, numeral 27, developer removing member, numerals 28*a* and 28b, an upper cover and lower cover respectively, numeral 29, an insulation member, numerals 30 and 31, wiring that connects each conductive member to power source 34, numeral 32, a toner replenishing container, numeral 33, a toner replenishing roller, numeral 34, developing bias power supply. Numeral 35, an electrification unit that makes the toner image transferable, numeral 36, a transferring electrode, numeral 37, a separation electrode, charter P, a transfer paper, numeral 38, a cleaning electrification removing unit consisting of an electrification removing electrode 38a and electrification removing lamp 38b. Numeral 39 is a cleaning unit having a cleaning blade 39a and an auxiliary cleaning brush 39b.

To form an image by using the copier structured as described above, a latest image is formed by applying an image exposure L to the surface of sensitive material 20 after it has been made to attain a uniform positive electrification by means of an electrification unit 21. The said latest image is developed by means of the developer D prescribed as below while a developing bias from power supply 34 is being applied to it. This toner image is transferred to transfer paper P which is timely supplied by the working of transfer electrode 36 after the toner image has been made easy to be transferred by means of the electrification unit 35. Thereafter, the transfer paper P is separated from sensitive material 20 by the working of separation electrode 37, and is then sent to a heating unit (unshown) or a solvent fixing unit and is ejected after it has been fixed.

In the meantime, the toner remaining on the sensitive material 20 after transfer is made easy to be cleaned by means of cleaning front electrification removing unit 38's electrification removing electrode 38a and electrification removing lamp 38b. It is subsequently cleaned by the cleaning blade 39a of cleaning unit 39 and the toner remained on the sensitive material when blade 39 separated is cleaned by auxiliary brush 39b. Thus the machine becomes ready for the next image formation.

| (Developer Prescription) | |
|---|---|
| Toner constituents: | |
| Polystyrene | 25 wt % |
| Polymethymethacrylate | 64 wt % |
| Varifast (electric charge control agent) | 0.8 wt % |
| Carbon black | 10 wt % |
| Magnetite impalpable powder | 0.2 wt % |

A toner with a resistance rate of more $10^{14}\Omega$cm, an average particle diameter of 5 μm, and an average electrification amount of −30 uc/g can be obtained by mixing, kneading and diving the aforementioned constituents.

| Carrier constituents: | |
|---|---|
| Polystyrene-methylmethacrylate (1 to 1) Copolymer | 40 wt % |
| Magnetite powder | 60 wt % |

A carrier with the resistance rate of more than $10^{14}\Omega$cm, an average particle diameter of 10 μm, and a magnetization of 30 emu/g can be obtained by mixing, kneading, and dividing followed by the hot wind blast and particles globular shaping processings.

Next, an intended developer D can be obtained by sufficiently mixing an amount of 85 wt % of the aforementioned carrier with an amount of 15 wt % of the toner.

Note that the operating conditions of each operating unit in the above-mentioned image forming process are shown in Table 13 below.

TABLE 13

| Operating unit | Image forming condition |
|---|---|
| Sensitive material | Selenium photoconductive material (Regular development) |
| Linear speed of sensitive material | 100 mm/s |
| Latent image potential (nonexposure area) | +700 V |
| Latent image potential (exposure area) | +20 V |
| Sleeve diameter | 20 mm |
| Sleeve revolutions | 50 r.p.m. |
| Total magnetic poles | 8 Poles (N and S alternately arranged) strength of magnetic force; Up to 700 G |
| Magnetic roll revolutions | 1000 r.p.m. |
| Stirring member revolutions | In the same direction of sleeve; 800 r.p.m. |
| Developing DC bias | +100 V |
| Developing AC bias | 1500 V (p-p) at 2 KHz |
| Developing gap | 1000 μm |
| Developer layer thickness | 40 μm |

As the result of repeated image formations under the above-mentioned image forming conditions, a generally superior copy image that is not accompanied by noise arising from discharge lightning in the developing unit, but is improved by a high resolution and tone reproductivity was obtained.

EXAMPLE 8

An image was formed under the image forming conditions described in Table 14 by using a copier shown in FIG. 14 on condition (reversing development) that negative electrification is applied to the sensitive material and a developer below is used.

| (Developer D Prescription) | |
|---|---|
| Toner constituents: | |
| Polystyrene | 25 wt % |
| Polymethlmethacrylate | 64 wt % |
| Varifast | 0.3 wt % |
| Carbon black | 10.5 wt % |
| Magnetite palpable powders | 0.2 wt % |

An intended toner with a specific resistance of more than $10^{14}\Omega$cm, an average particle diameter of 10 μm, and an average electrification amount of −10 μc/g can be obtained by mixing, kneading and dividing the aforementioned constituents.

| Carrier constituents: | |
|---|---|
| Polystyrene methylmethacrylate (1 to 1) Copolymer resin | 30 wt % |
| Magnetite palpable powders | 70 wt % |

An intended carrier with a specific resistance of more than $10^{14}\Omega$cm, an average particle diameter of 20 μm, and a magnetization of 50 emu/g can be obtained by mixing, kneading the above constituents followed by the hot wind blast and particle globular shaping processings.

Next, an intended developer D can be obtained by sufficiently mixing an amount of 80 wt % of the aforementioned carrier with an amount of 20 wt % of the toner.

TABLE 14

| Operating unit | Image forming condition |
|---|---|
| Sensitive material | Organic photoconductive material (reversal type) |
| Linear speed of sensitive material | 150 mm/s |
| Latent image (Nonexposure area) | −700 V |
| Latent image (Exposure area) | −50 V |
| Sleeve diameter | 20 mm |
| Sleeve revolutions | 150 r.p.m. |
| Total magnetic electrodes | 8 electrodes (N and S arranged alternately) Maximum magnetic strength: 700 G |
| Magnetic roll revolutions | 1000 r.p.m. |
| Stirring member revolutions | 1000 r.p.m. in the same revolving direction as sleeve's |
| Developing DC bias | −500 V |
| Developing AC bias | 800 V (p-p) at 2 KHz |
| Developing gap | 500 μm |
| Developer layer thickness | 200 μm |

Providing that the organic photoconductive material consists of a lower layer, i.e., a carrier generation layer containing bisazo pigment and an upper layer, i.e., a carrier transport layer containing triphenylamine.

The copier images thus formed were found to be excellent in resolution and tone reproductivity as well as those described in Example 7.

EXAMPLE 9

FIG. 7 is a cross sectional view of the structure of the image forming unit used in the tests, in which the image input unit IN consists of an illumination light source 21, a mirrow 22, a lens 23, and a prime color CCD pickup element all of which are incorporated into one unit. The image input unit IN is moved in the arrow direction by means of a driving unit (unshown), and the CCD pickup element reads document 25. An alternative method is to fix the image input unit IN and the document 25 is moved by the document table.

Image information read by the image input unit IN is converted into data suitable for recording by the image processing unit TR.

Laser optical system 26 forms a latent image on image forming material 20 based on the above-mentioned image data, and this latent image is developed thereby forming a toner image on the image forming material 20. A uniform electrification is applied to the surface of image forming material 20 by means of a Scorotron electrification electrode 27. Next, an image exposure L in accordance with the recorded data is applied to the surface of the image forming material 20 by means of the laser optical system 26. Thus, an electrostatic latent image is formed. This latent image is developed by the developing unit A that accommodates an yellow toner. The image forming material 20 on which a toner image was formed is again made to attain a uniform electrification by means of the Scorotron electrification electrode 27, and the image exposure L in accordance with the recorded data of different color is applied to it. The electrostatic latent image formed is developed by the developing unit B that accommodates magent toner. As a result, a 2-color toner image of yellow and magnet toners are formed on the image forming material 20. By repeating the same procedures, cyanine toner and black toner are developed one on top of another, and a 4-color toner image is formed on the image forming material 20. Note that all of the above-mentioned developing units of A, B, C, and D have the same structure as that of the developing unit shown in FIG. 1.

The multicolored toner image thus obtained is transferred to the transfer paper P by means of transcription electrode 29 after the image's electrification has been removed and made to be easily transferred by exposure lamp 28. The recording paper P is separated form the image forming material 20 by separation electrode 30, and is then fixed by fixing unit 31. In the meantime, the image forming material 20 is cleaned by both electrification removing electrode 32 and cleaning unit 33.

Cleaning unit 33 is equipped with a cleaning blade 34 and a fur brush 35. They are kept form making contact with the image forming material 20 while an image is being formed, and when a multicolored image is formed on the image forming material 20, they come into contact with the image forming material 20 thereby removing the remnant of the toner. Thereafter, the cleaning blade 34 separates from the image forming material 20, and the fur brush 35 separates from it a little later. The fur brush 35 removes the toner remaining on the image forming material 20 when it separates from the image forming material 20. Numeral 36 is a roller that collects the toner removed by the blade 34

Laser optical system 26 is shown in FIG. 6(*b*) in which numeral 37 is a semiconductor laser oscillator, numeral 38, a revolving multisided mirrow, and numeral 39, an f0 lens.

Also, in such an image forming unit, taking an image exposure commencement timing by putting an optical mark on the sensitive material so that it can be read by an optical sensor is effective.

The said image forming process in the copier shown in FIG. 7 is developed by means of a reversing developing method using the developer as prescribed below. Subsequently, an image is formed in accordance with the image forming conditions described in Tables 1 through 4 and operating timing of each operating unit described in FIG. 8. (In the said diagrams, the high level means that each operating unit is in motion.)

| (Developer Prescription) | |
|---|---|
| Toner constituents: | |
| Polystyrene | 25 wt % |
| Polymethylmethacrylate | 64 wt % |
| Varifast (Electric charge control agent) | 0.3 wt % |
| Coloring agent | 10.5 wt % |
| Magnetite powders | 0.2 wt % |

Providing that the following coloring agents were used: tartrazine for yellow toner; rhodamine B for magenta toner; copperphthalocyanine for cyan toner, and carbon black for black toner.

An intended toner can be obtained by mixing, kneading and dividing the aforementioned constituents.

| Carrier constituents: | |
|---|---|
| Styrene-methylmethacrylate (1:1) copolymer resin | 30 wt % |
| Magnetite powders | 70 wt % |

A toner with globular-shaped particles can be obtained by mixing, kneading and dividing the above-mentioned constituents followed by hot air blast processing. Next, an intended developer can be obtained by sufficiently mixing an amount of 80 wt % of the above-mentioned carrier with an amount of 20 wt % of the toner.

TABLE 15

| Image forming material and developing unit | | Condition |
|---|---|---|
| Image forming material | Sensitive layer | Organic photoconductive layer |
| | Drum diameter | 140 mm |
| | Circumferential speed | 80 mm/sec |
| Electrification | Nonexposure area potential | −700 V |
| | Exposure area potential | −50 V |
| Image exposure L | Light source | Semiconductor laser |
| | Wavelength | 750 nm |
| | Recording density | 16 dots/mm |
| Developing unit all of A, B, C, and C developing units | Sleeve | Diameter 20 mm ϕ 100 r.p.m. |
| | Magnetic roll | 8 poles 1000 r.p.m. |
| | Magnetic flux density of sleeve surface (maximum) | |

TABLE 16

| Condition | Average particle diameter μm | Specific resistance μ cm | Amount of electrification μc/g | Toner density wt % |
|---|---|---|---|---|
| carrier | 10 | More than $10^{14}$ | Resin processed magnetite particles with magnetization 40 e.m.u./g | |
| Toner Yellow | 5 | More than $10^{14}$ | −30 | 20 |
| Magenta | 5 | More than $10^{14}$ | −30 | 20 |
| Cyan | 5 | More than $10^{14}$ | −30 | 20 |
| Black | 4 | More than $10^{14}$ | −30 | 20 |

TABLE 17

| Development | Condition D.C. | A.C. | |
|---|---|---|---|
| Bias during development | | | |
| Yellow development | −600 V | 2 KHz (frequency) | 1 KV (between peaks) |
| Magenta development | −600 V | 2 KHz | 1 KV |
| Cyan development | −600 V | 2 KHz | 1 KV |
| Black development | −600 V | 2 KHz | 1 KV |
| Bias during nondevelopment | | | |
| common to development of all colors | 0 V | Less than 0.3 KV at 2 KHz | |
| Both magnetic roll and sleeve are brought to a stop | | | |
| Gap d between sensitive material 1 and sleeve 22 | (common to the development unit of each color) 0.5 mm | | |

TABLE 17-continued

| Development | Condition D.C. | A.C. |
|---|---|---|
| Developer layer thickness in the development domain | (Common to the development unit of each color) 100 μm | |
| Developing order | (Yellow) → (Magenta) → (Cyan) → (Black) | |

TABLE 18

| Other processing system | |
|---|---|
| Transferring | Corona discharging system |
| Fixing | Heatroll system |
| Cleaning | Blade and fur bruch are used |

Note that the organic sensitive layer described in Table 1 consists of a function-division type sensitive layer with a lower layer composed of a carrier generation layer containing trisazo pigment and an upper layer composed of a carrier transport layer containing an aromatic compound. This organic sensitive layer is used by a noncontacting developing method of the reversal developing method. In the timing chart shown in FIG. 8, lateral axis shows an image forming process, and vertical axis shows each image forming unit. Also, marks A, B, C, and D show an yellow toner developing, magent toner developing, and black toner developing units respectively.

A multicolored image created under the above-mentioned condition was found to have a high resolution and an excellent pseudo half-tone reproductivity. The scattering of toner and carrier was also restrained to a minimum.

EXAMPLE 10

Figure 2A:
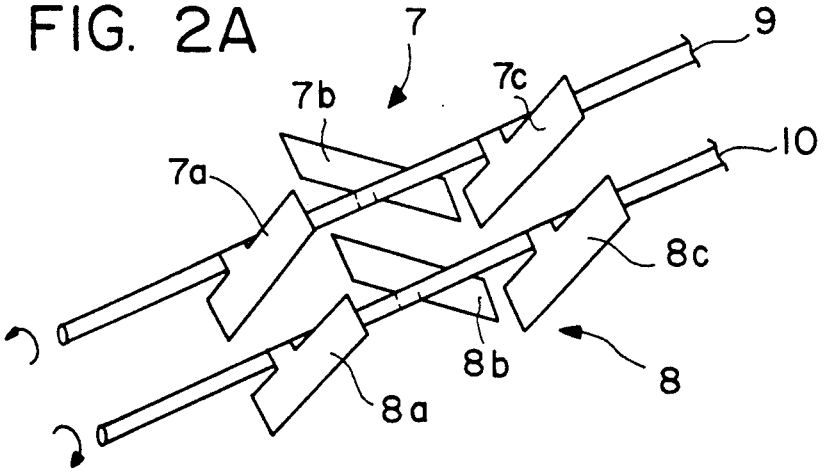
FIG. 2 is a mixing member to be adapted for use by a developing device of the present invention.
Figure 2B:
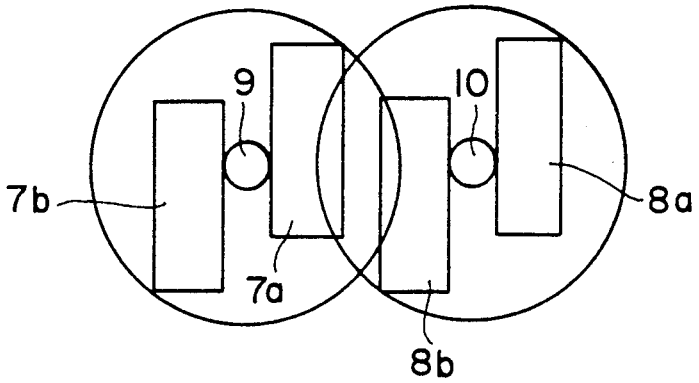

FIG. 11 is a cross sectional view of the principal portions of a copier which is intended to be used to explain this embodiment of the invention. In the diagram, numeral 20 is a sensitive material that rotates in the arrow direction, numeral 21, a positive corona electrification unit, character L, an image exposure, numeral 22, a developing unit with the same structure as that of the one shown in FIG. 1, numeral 23, an aluminum sleeve that rotates in the arrow direction, numeral 24, a magnetic roll with 8 electrodes, N and S arranged alternately that rotates in the arrow direction, numeral 25, a thin layer forming member, numeral 26, a fixing member that fixes the said thin layer forming member, numerals 27 and 28 are 1st and 2nd stirring member with the same structure as shown in FIG. 2 and rotates in the arrow direction, namely, in opposite direction to each other, numeral 29, a toner replenishing container, numeral 30, a replenishing roller, and numeral 31, a developing bias power supply.

Numeral 32 is an electrification unit that gives a transcriptive capability to a toner image, numeral 33, transcription electrode, numeral 34, a separation electrode, character P, transfer paper, and numeral 35 is a cleaning electrification removing unit consisting of an electrification removing electrode 35*a* and an electrification removing lamp 35*b*.

Numeral 36 is a cleaning unit consisting of a cleaning blade 36*a* and an auxiliary cleaning brush 36*b*.

To form an image by using a copier structured as described above, first, a latent image is formed by means of an image exposure L applied after the surface of sensitive material 20 is made to attain a uniform electrification by means of electrification unit 21. The said image is developed under the contacting method while a developing bias is being applied to the image from power supply 31 by using developer D prepared in accordance with the prescription below. Thus a toner image is formed.

This toner image is transferred by the working of transcription electrode 33 to transfer paper P timely fed after it has been made easier to be transferred by means of electrification unit 32. Thereafter, the transfer paper P is separated from sensitive material 20 by the working of separation electrode 34, and is ejected after it has been sent to and fixed by either a heating or a solvent fixing unit.

In the meantime, the remaining toner on sensitive material 20 is made easier to be cleaned by means of the electrification removing electrode 35*a* and electrification removing lamp 35*b* of cleaning front electrification removing unit 35 and is subsequently cleaned by the blade 36*a* of cleaning unit 36. The toner remained on the sensitive material is cleaned by auxiliary brush 36*b* when the blade 36*a* separates from the sensitive material and thus the machine is ready for the next image formation.

| (Developer D Prescription) | |
|---|---|
| Toner constituents: | |
| Polystyrene | 25 wt % |
| Polymethylemethacrylate | 64 wt % |
| Varifast (electric charge control agent) | 0.8 wt % |
| Carbon black | 10 wt % |
| Magnetite powders | 0.2 wt % |

A toner with a resistance rate of more than $10^{14}\Omega$cm, an an average particle diameter of 7 μm, and an average electrification amount of −30 μc/g can be obtained by mixing, kneading and dividing the above constituents.

| Carrier constituents: | |
|---|---|
| Styrene methylmethacrylate (1 to 1) Copolymer resin | 40 wt % |
| Magnetite powders | 60 wt % |

A carrier with a resistance rate of more than $10^{14}\Omega$cm, an average particle diameter of 10 μm, and a magnetization of 30 emu/g can be obtained by mixing, kneading, and dividing the above-mentioned constituents followed by the hot air blast and globular-shaped particle processings.

Note that the operating conditions of each operating unit in the aforementioned image forming processes are shown in Table 19 below.

TABLE 19

| Operating unit | Image forming condition |
|---|---|
| Sensitive material | Se photoconductive material (regular development) |
| Linear speed of sensitive material | 100 mm/s |
| Latent image potential (Nonexposure area) | +700 V |
| Latent image potential (Exposure area) | −20 V |
| Sleeve diameter | 20 mm |
| Sleeve revolutions | 120 r.p.m. |
| Total magnetic poles | 8 poles (N and S alternately arranged), strength of magnetic force on the sleeve (maximum |

TABLE 19-continued

| Operating unit | Image forming condition |
|---|---|
| | 700 G) |
| Magnetic roll revolutions | 800 r.p.m. |
| Stirring member revolutions | 800 r.p.m. |
| Developing bias DC | +100 V |
| Developing bias AC | 500 V (p-p) |
| Developing gas | 300 μm |
| Developer layer thickness | 50 μm |

Image formation was repeated under the aforementioned image forming conditions. As a result, copper images with a generally superior picture quality including a high resolution and tone reproductivity without accompanying the scattering of carrier and toner were obtained.

EXAMPLE 11

Images were experimentally formed under the image forming conditions described in Table 2 (reversing development) by using the copier shown in FIG. 11 on condition that negative electrification is applied to the sensitive material and the developer below is used.

| (Developer D Prescription) | |
|---|---|
| Toner constituent: | |
| Polystyrene | 25 wt % |
| Polymethylmethacrylate | 64 wt % |
| Varifast | 0.3 wt % |
| Carbon black | 10.5 wt % |
| Magnetite powders | 0.2 wt % |

A toner with a specific resistance of more than $10^{14}\Omega$cm, an average particle diameter of 10 μm, and an average electrification amount of −10 μc/g can be obtained by mixing, kneading and dividing the above-mentioned constituents.

| Carrier constituents: | |
|---|---|
| Polystyrene-methylmethacrylate (1:1) Copolymer resin | 30 wt % |
| Magnetite powders | 70 wt % |

A carrier with a specific resistance of more than $10^{14}\Omega$cm, an average particle diameter of 20 μm, and a magnetization of 50 emμ/g can be obtained by mixing, kneading and dividing the above constituents followed by hot air blast and particle globular shaping processings.

Next, an intended developer D can be obtained by sufficiently mixing an amount of 80 wt % of the above-mentioned carrier with an amount of 20 wt % of the toner.

TABLE 20

| Operating unit | Image forming condition |
|---|---|
| Sensitive material | Organic photoconductive material (reversal development) |
| Linear speed of sensitive material | 150 mm/s |
| Latent image potential (Nonexposure area) | −700 V |
| Latent image potential (Exposure area) | −50 V |
| Sleeve diameter | 20 mm |
| Sleeve revolutions | 200 r.p.m. |
| Total magnetic poles | 8 poles (N and S alternately arranged), the strength of magnetic force on the sleeve (Up |

TABLE 20-continued

| Operating unit | Image forming condition |
|---|---|
| | to 700 G) |
| Magnetic revolution | 1000 r.p.m. |
| Stirring member revolutions | 1000 r.p.m. |
| Developing bias DC | −600 V |
| Developing bias AC | 1 KV (p-p) |
| Developing gap | 500 μm |
| Developer layer thickness | 100 μm |

Note that the organic sensitive material should consist of a lower layer composed of a carrier generation layer containing bisazo pigment and an upper layer composed of a carrier transport layer containing triphenylamine.

Copier images thus formed were recognized to be excellent in resolution and tone reproductivity as well as those described in Example 1.

What is claimed is:

1. A method for forming a multicolor toner image on an electrostatic latent image carrying member, said method comprising (a) forming an electrostatic latent image on said electrostatic latent image carrying member, (b) supplying a developer containing a carrier and a toner to the outer circumference surface of a cylinder-shaped sleeve member of at least one developer transporting means of a plurality of developing means disposed opposite said latent image carrying member, said developer transporting means comprising said cylinder-shaped sleeve member having a center axis, at least one pair of magnetic poles provided inside said sleeve member whereby said magnetic poles are directed to an inner surface of said sleeve member, said magnetic poles and said sleeve member being so arranged as to be rotatable in relation to each other around the center axis of said sleeve member, and a means for regulating the thickness of the developer layer formed on the surface of said sleeve member so that the amount of toner on said sleeve member [mt] in mg/cm$^2$, the peripheral speed of said image surface [Vd] and the peripheral speed of said sleeve member [Vsl] satisfy the following relation:

$$|Vsl/Vd| \times mt \geqq 0.4\ (mg/cm^2)$$

$$|Vsl/Vd| \leqq 10$$

(c) forming a thin layer of said developer on the surface of said sleeve member so that the maximum thickness of the developer layer is less than a minimum distance between the surface of said sleeve member and the surface of the electrostatic latent image carrying member disposed opposite to said developer transporting member, (d) bringing said developer into close proximity to the electrostatic latent image formed on said electrostatic image carrying member, (e) developing said electrostatic latent image, and (f) repeating steps (a) to (e)

2. The method of claim 1, wherein said steps (a) to (e) are repeated by using a different color toner from that used in a previous time.

3. A method of developing an electrostatic latent image on a rotatable image surface of an image carrying member, said method comprising;

supplying a developer containing a magnetic carrier and a toner to a developer transporting means, said transporting means including a rotatable cylindrical sleeve member and a magnetic member provided inside said sleeve member whereby the developer is attracted to and forms a developer layer on said sleeve member, said sleeve member facing said image surface with a distance therebetween so as to form a developing zone, regulating the amount of developer to be transported to the developing zone by a developer-regulating means so that the amount of toner on said sleeve member [mt] in mg/cm$^2$, the peripheral speed of said image surface [Vd] and the peripheral speed of said sleeve member [Vsl] satisfying the following relation:

$$|Vsl/Vd| \times mt \geqq 0.4\ (mg/cm^2)$$

$$|Vsl/Vd| \leqq 10$$

said developer regulating means bearing against said developer layer whereby the thickness of said developer layer is less than said distance, bringing the developer into close proximity to the electrostatic latent image formed on said image surface, and adhering the toner to a low potential portion of said electrostatic latent image.

4. The method of claim 4 wherein said electric bias is applied between said image-carrying member and said sleeve member.

5. The method of claim 4 wherein a peak-to-peak voltage (Vp−p) of said electric bias, the maximum thickness (h) of the developer layer in said developing zone, and the distance (d) between said image carrying member and said sleeve member in said developing zone satisfy the following relation;

$$5 \leqq (Vp-p)/(d-h) \leqq 50\ KV/mm.$$

6. A method of developing an electrostatic latent image on a movable image surface of an image carrying member, said method comprising supplying a developer containing magnetic carrier particles and toner particles to a developer transporting means, said transporting means including a rotatable cylindrical sleeve member and a magnetic member provided inside said sleeve member whereby said developer is attracted to and forms a developer layer on said sleeve member, said sleeve member being disposed to face said image surface with a distance therebetween to form a developing zone, regulating the amount of developer to be transported to said developing zone by an elastic developer regulator, said developer regulator bearing against said developer layer whereby the thickness of said developer layer in said developing zone is less than said distance, bringing the developer into close proximity to the electrostatic latent image formed on said image surface, forming a toner image while applying an electric bias having an oscillating component, a peak-to-peak voltage (Vp−p) of said oscillating component of said electric bias, the maximum thickness (h) of the developer layer in said developing zone, and the distance (d) between said image carrying member and said sleeve member in said developing zone satisfy the following relation;

$$5 \leqq (Vp-p)/(d-h) \leqq 50\ KV/mm.$$

7. The method of claim 6 wherein said carrier particles are spherical.

8. The method of claim 7 wherein said carrier particles are not more than 50 μm in diameter.

9. The method of claim 8 wherein carrier particles are 5 to 30 μm in diameter.

10. The method of claim 8 wherein said toner particles are not more than 15 μm in diameter.

11. The method of claim 10 wherein said toner particles are 1 to 5 μm in diameter.

12. The method of claim 6 wherein said carrier particles are electrically insulated.

13. The method of claim 12 wherein said developer is in a developer container which has a conductive member therein, and said conductive member has substantially the same potential as that of said developer container.

14. The method of claim 6 wherein said elastic developer-regulating means is an elastic plate member.

15. The method of claim 14 wherein a free end of said elastic plate member is placed against the direction of the movement of the developer.

16. The method of claim 15 wherein said carrier particles are spherical.

17. The method of claim 16 wherein said carrier particles are 5 to 30 μm in diameter.

18. The method of claim 17 wherein said toner particles are 1 to 5 μm in diameter.

19. The method of claim 5 wherein said maximum thickness is not more than 300 μm.

20. The method of claim 19 wherein said minimum distance is 200 to 700 μm.

21. The method of claim 20 wherein said carrier particles are spherical.

22. The method of claim 21 wherein said carrier particles are 5 to 30 μm in diameter.

23. The method of claim 22 wherein said toner particles are 1 to 5 μm in diameter.

24. The method of claim 6 wherein said developing is reversal development.

25. The method of claim 6 wherein said elastic developer-regulator comprises a rigid member bearing against said developer and an elastic means attached to said rigid plate and a support.

26. The method of claim 25 wherein said rigid member is a roller.

* * * * *